United States Patent [19]

Perkins

[11] 4,413,677

[45] Nov. 8, 1983

[54] DUAL STRING WELL PACKER

[75] Inventor: Donald H. Perkins, Carrollton, Tex.

[73] Assignee: Otis Engineering Corporation, Dallas, Tex.

[21] Appl. No.: 372,138

[22] Filed: Apr. 27, 1982

[51] Int. Cl.[3] ..... E21B 29/00; E21B 23/08

[52] U.S. Cl. ..... 166/55.1; 166/120; 166/134; 166/212

[58] Field of Search ..... 166/55, 55.1, 120–122, 166/134, 212, 376, 377, 382, 387

[56] References Cited

U.S. PATENT DOCUMENTS

| | | | |
|---|---|---|---|
| 2,711,795 | 6/1955 | Ragan | 166/120 |
| 3,167,127 | 1/1965 | Sizer | 166/120 |
| 3,215,207 | 11/1965 | Sizer | 166/212 |
| 3,275,079 | 9/1966 | Crow | 166/134 |
| 3,374,837 | 3/1968 | Page et al. | 166/120 |
| 3,381,752 | 5/1968 | Elliston | 166/120 |
| 3,391,741 | 7/1968 | Elliston | 166/123 |
| 3,410,348 | 11/1968 | Page | 166/134 |
| 4,156,460 | 5/1979 | Crowe | 166/134 |
| 4,236,734 | 12/1980 | Ahangarzadeh | 285/26 |

OTHER PUBLICATIONS

Composite Catalog of Oil Field Equipment and Services 34th Revision (1980–1981) vol. 4, pp. 5972 and 6085.

Otis Wireline Subsurface Flow Controls & Related Service Equipment Catalog (OEC 5121c), pp. 14, 15, 17, 25 and 119.

*Primary Examiner*—Ernest R. Purser
*Assistant Examiner*—Thuy M. Bui
*Attorney, Agent, or Firm*—Thomas R. Felger

[57] ABSTRACT

A well packer which is anchored downhole within the bore of a casing string by opposing slips. The well packer is hydraulically set. One embodiment of the invention allows the packer to be released from its downhole location by cutting the packer mandrels below the packing elements. The invention is particularly adapted for use with a dual string well packer. However, the anchoring and releasing mechanism of the present invention can be readily adapted for use with a single string well packer. Use of the present invention with a dual string packer is particularly desirable because it allows combining the features of hydraulic setting downhole, opposing slips for better resistance to differential pressure in either direction, and selective releasing of the packer from the downhole location.

16 Claims, 34 Drawing Figures

DUAL STRING WELL PACKER

BACKGROUND OF THE INVENTION

1. Field of the Invention

This invention relates to a well packer for forming a fluid barrier between the interior of a casing string and the exterior of a tubing string.

2. Description of the Prior Art

Well packers for directing formation fluid flow through a tubing string have been used for many years in the oil and gas industry. Well packers have been designed to accommodate one, two or more tubing strings. Examples of prior dual string well packers are shown in U.S. Pat. No. 3,167,127 to P. S. Sizer; U.S. Pat. No. 3,381,752 to T. L. Elliston; and U.S. Pat. No. 3,391,741 toT. L. Elliston. These patents are incorporated by reference for all pruposes within this application.

SUMMARY OF THE INVENTION

The present invention discloses a well packer comprising a pair of parallel mandrel means, each having a passageway extending therethrough; upper and lower body means carried on the exterior of the mandrel means and slidable longitudinally with respect to each other over the mandrel means; anchoring means carried by each body means and radially movable relative to each body means between a retracted position and an expanded position whereby each anchoring means is engageable with the interior of a casing string to prevent longitudinal movement of its associated body means relative to the casing string; packing means carried on the exterior of the mandrel means between the upper and lower body means; piston means, carried by said mandrel means, for moving the body means longitudinally toward each other in response to fluid pressure in one of said passageways; the longitudinal movement of the body means causing compression of the packing means and radial expansion thereof to form a fluid barrier between the exterior of the mandrel means and the interior of the casing string; the same longitudinal movement causing radial expansion of the anchoring means; means for locking each body means to the mandrel means after completion of the longitudinal movement whereby the packing means are maintained compressed and the anchoring means are maintained radially expanded; each anchoring means comprising a plurality of slip elements; each body means further comprising a slip carrier and a slip expander which are movable longitudinally towards each other to radially expand the associated slip elements; means for releasing the mandrel means from the locking means of the lower body means; and means for moving the slip expander of the upper body means longitudinally away from its associated slip carrier to allow retraction of the slip elements carried by the upper means after the locking means for the lower body means has been released.

One object of the present invention is to provide a dual string packer which does not require relative movement between the primary string mandrel and secondary string mandrel while setting the packer.

Another object of the present invention is to provide a well packer, either single or dual string, which can be released from its downhole set position by cutting the mandrel means below the packing elements.

A further object of the present invention is to provide a dual string well packer which is hydraulically set and has opposing slips on opposite ends of the packing element(s).

An additional object of the present invention is to provide a dual string hydraulically set packer which does not require moving seals on either the primary or secondary mandrel while setting the packer with the exception of the setting piston.

A still further object of the present invention is to provide a dual string well packer which has a continuous primary string mandrel and secondary string mandrel extending through the packing elements.

Another object of the present invention is to provide a dual string well packer which when set will resist both tension and compression forces within the tubing strings.

A further object of the present invention is to provide a dual string well packer which has the operational characteristics of a permanently set packer but can be removed from the well bore without having to mill or grind up the packer.

Additional objects and advantages of the present invention will be readily apparent to those skilled in the art from reading thr following description in conjunction with the drawings and claims.

BRIEF DESCRIPTION OF THE DRAWINGS

FIG. 25 is a drawing in radial section taken along line 25—25 of FIG. 4A.

DESCRIPTION OF THE PREFERRED EMBODIMENTS

Figure 1:
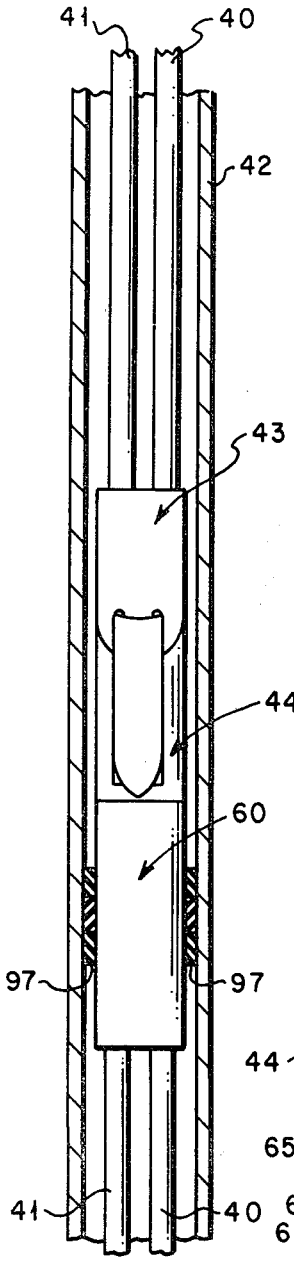
FIG. 1 is a longitudinal schematic view partially in section and elevation showing two parallel upper strings of production tubing coupled with two parallel lower strings of production tubing supported from a well packer set in a casing string.

In FIG. 1 a well completion is shown using dual production tubing strings 40 and 41. Production packer 60 is set to seal with the interior of casing 42 and to direct formation fluid flow through tubing strings 40 and 41 to the well surface (not shown). The lower portions of tubing strings 40 and 41 are suspended from packer 60. The upper portions of tubing strings 40 and 41 are attached to orienting head assembly 43. Orienting body 44 is attached to packer 60. Orienting head assembly 43 and orienting body 44 provide a system for releasably coupling the upper portions of tubing strings 40 and 41 to packer 60. This coupling system is fully described in U.S. Pat. No. 4,236,734 by Mansour Ahangarzadeh. Alternatively, the upper portions of tubing strings 40 and 41 could be directly attached to packer 60 by suitable threaded connections. However, the use of orienting head assembly 43 and orienting body 44 provides for greater flexibility in operating the well.

Packer 60 is built around a pair of parallel mandrel means 61 and 62 which have passageways 63 and 64 extending respectively therethrough. Mandrel means 61 and 62 include several sections of hollow tubing which are attached to each other by matching threads 143. O-rings 144 are used to prevent fluid leaks through threaded connections 143. Other sections of mandrel means 61 and 62 are designated as 61*a*, 61*b*, 61*c*, 62*a* 62*b*, 62*c* and 62*d* respectively. Orienting head assembly 43 and orienting body 44 have parallel longitudinal bores 45 and 46 which extend therethrough and communicate with passageways 63 and 64 respectively. A locator recess or profile 47 is provided in each bore 45 and 46 for use in releasing packer 60 from its set position. Recesses 47 may also be used for other well control purposes. Threads 50 are provided within bores 45 and 46 to connect orienting head assembly 43 with the upper portion of tubing strings 40 and 41.

Upper body means 65 is releasably secured to and surrounds the exterior of mandrel means 61 and 62. Upper body means 65 includes several subassemblies which are generally cylindrical and slidable with respect to each other and mandrel means 61 and 62. Upper slip carrier 66 is the portion of upper body means 65 immediately adjacent to orienting body 44. Coacting threads 48 are provided on the extreme end of mandrel means 61 and 62 and within bores 45 and 46 to attach orienting body 44 to packer 60. If desired, suitable threads could be placed on the extreme end of mandrel means 61 and 62 to allow direct attachment to tubing strings 40 and 41 respectively. An adapter sub or collar could be used in place of orienting body 44 to provide a suitable shoulder to abut slip carrier 66.

Figure 5:
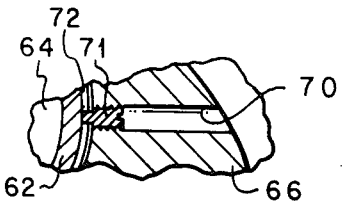
FIG. 5 is a fragmentary drawing in section taken generally along line 5—5 of FIG. 3B.
Figure 6:
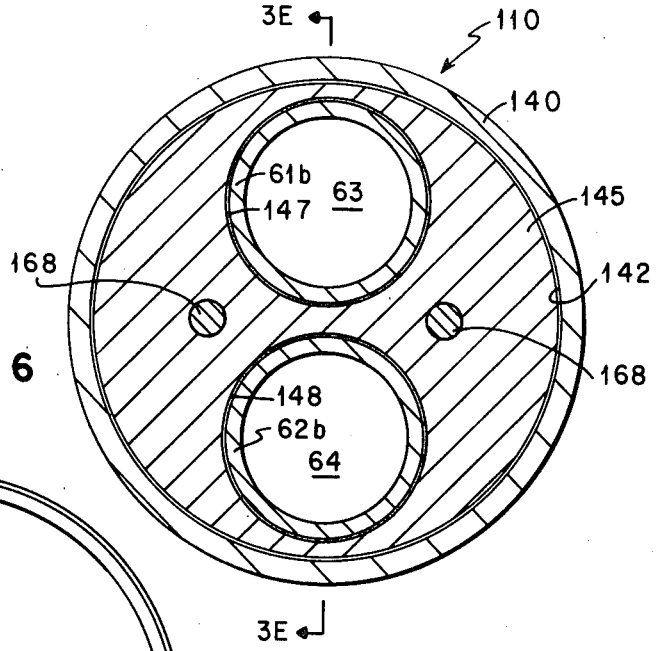
FIG. 6 is a drawing in section along line 6—6 of FIGS. 3E and 4C.

Slip carrier 66 has a plurality of external slip elements 67 attached thereto by conventional T-handles 68 and dove-tailed slots 69. A plurality of screw holes 70 is provided through the exterior of slip carrier 66 to allow insertion of shear screws 71 therein. Suitable annular grooves 72 are provided in the exterior of both mandrel means 61 and 62 adjacent to screw holes 70 to receive the extreme end of shear screws 71. As shown in FIG. 5, shear screws 71 releasably secure upper slip carrier 66 to mandrel means 61 and 62. Threads 48 and orienting body 44 preventing longitudinal movement of mandrel means 61 and 62 with respect to each other in the embodiment of the present invention shown in FIG. 3B. If orienting body 44 is not used, upper slip carrier 66 and shear screws 71 will also prevent longitudinal movement of mandrel means 61 and 62 with respect to each other until after screws 71 have been sheared.

Figure 3A:
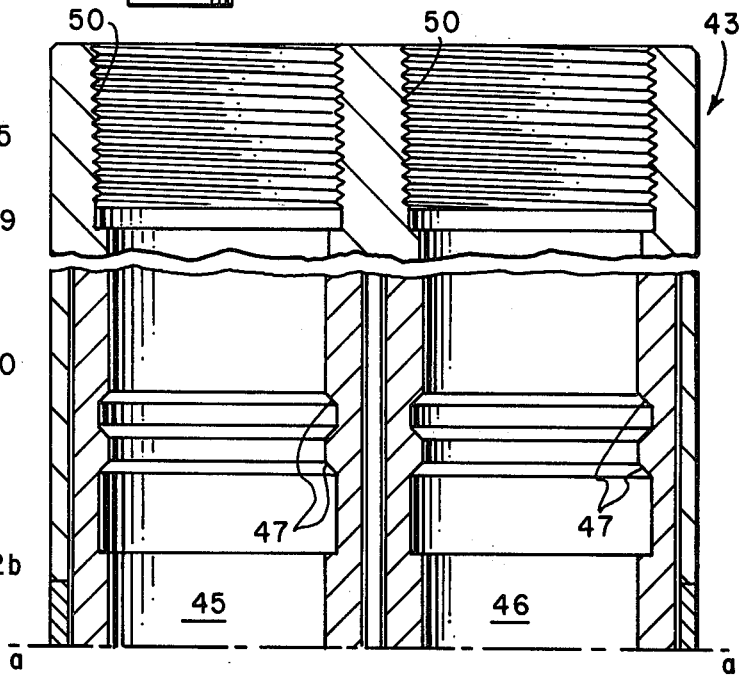
FIGS. 3A, B, C, D, E and F are drawings partially in section and elevation with portions broken away showing the well packer of FIGS. 2A–D incorporating one embodiment of the present invention.
Figure 3B:
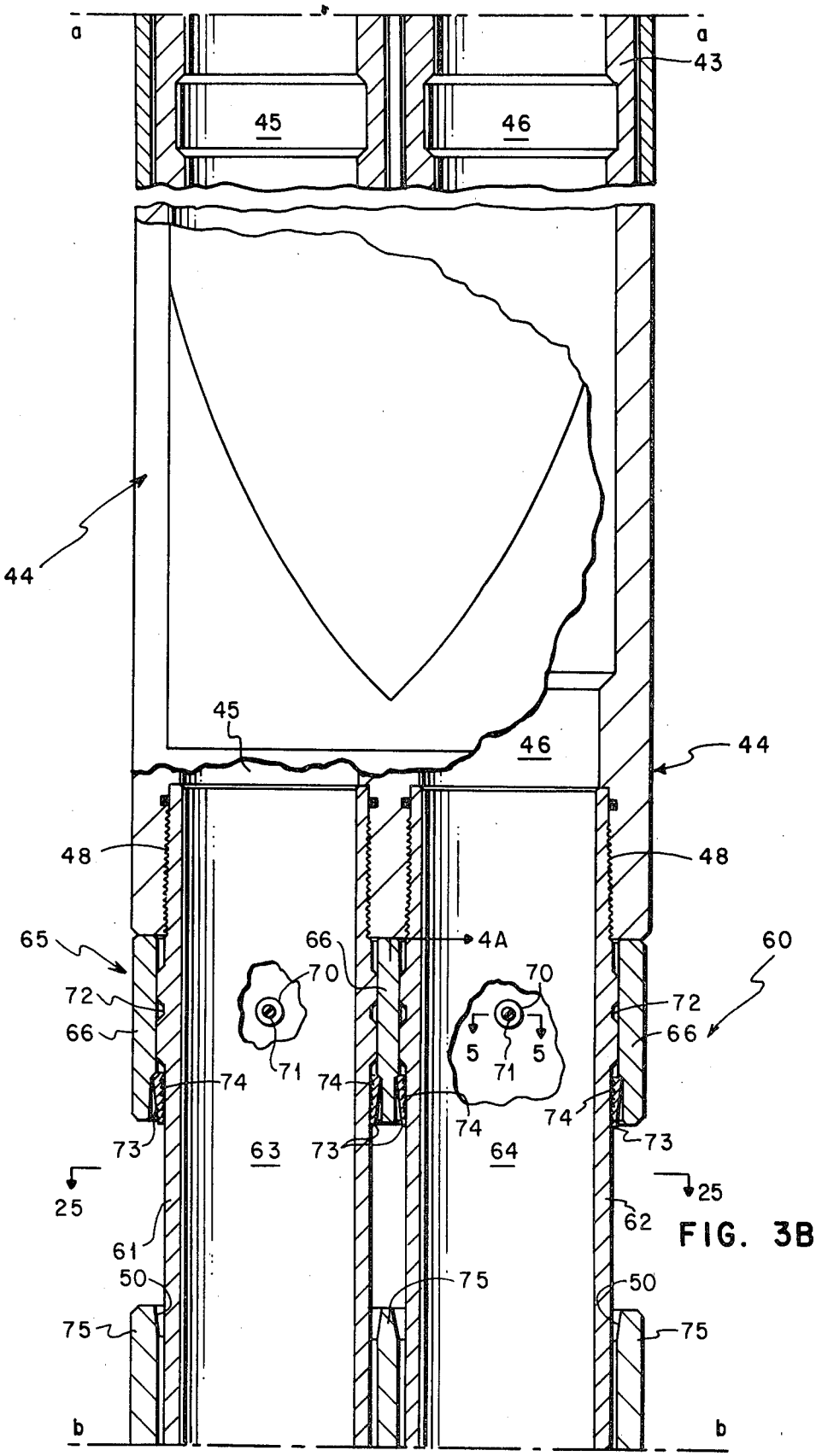
Figure 3C:
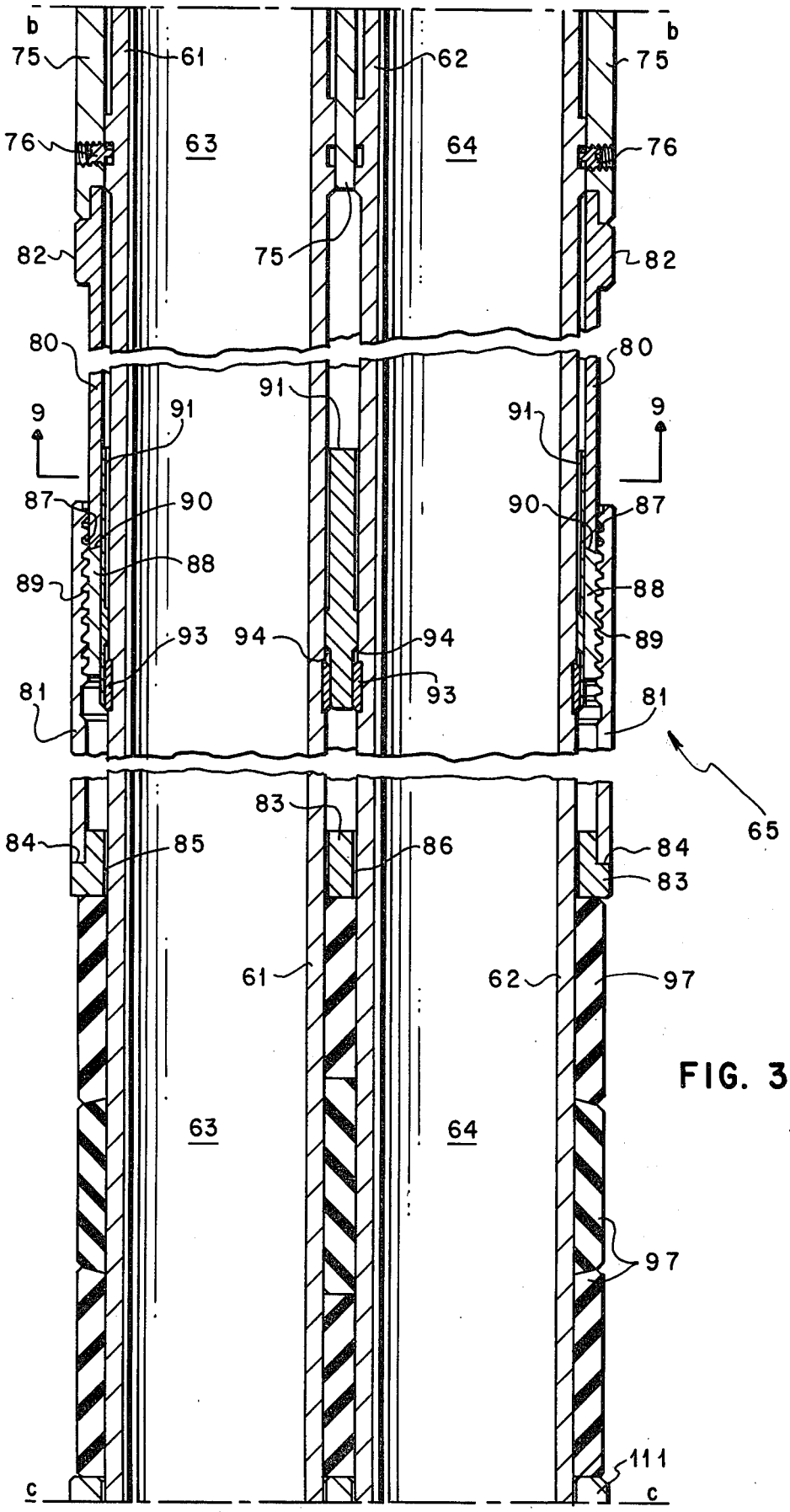
Figure 4A:
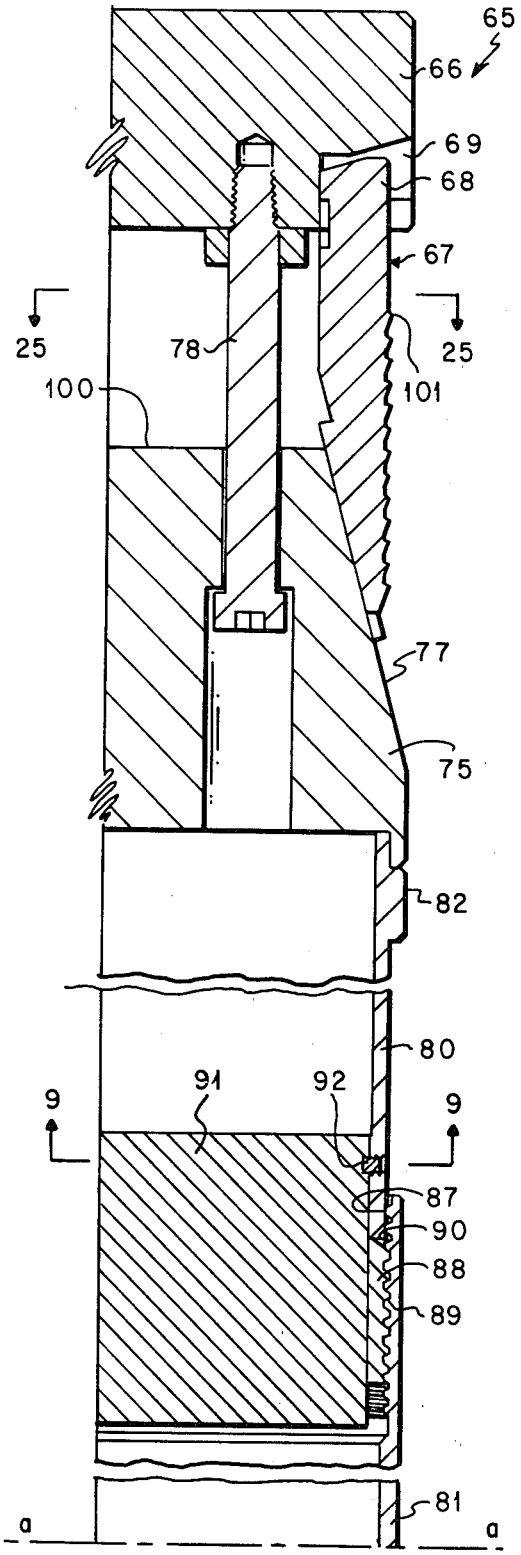
FIGS. 4A, B, C and D are drawings, partially in longitudinal section and elevation with portions broken away, of the packer shown in FIGS. 3A–F. The longitudinal section is generally shown rotated 90 degrees from the longitudinal section shown in FIGS. 3A–F. However, an irregular section is shown in the vicinity of the upper and lower external slips and the hydraulic piston's connecting tube.
Figures 16, 17, 18, 19, 20, 21:
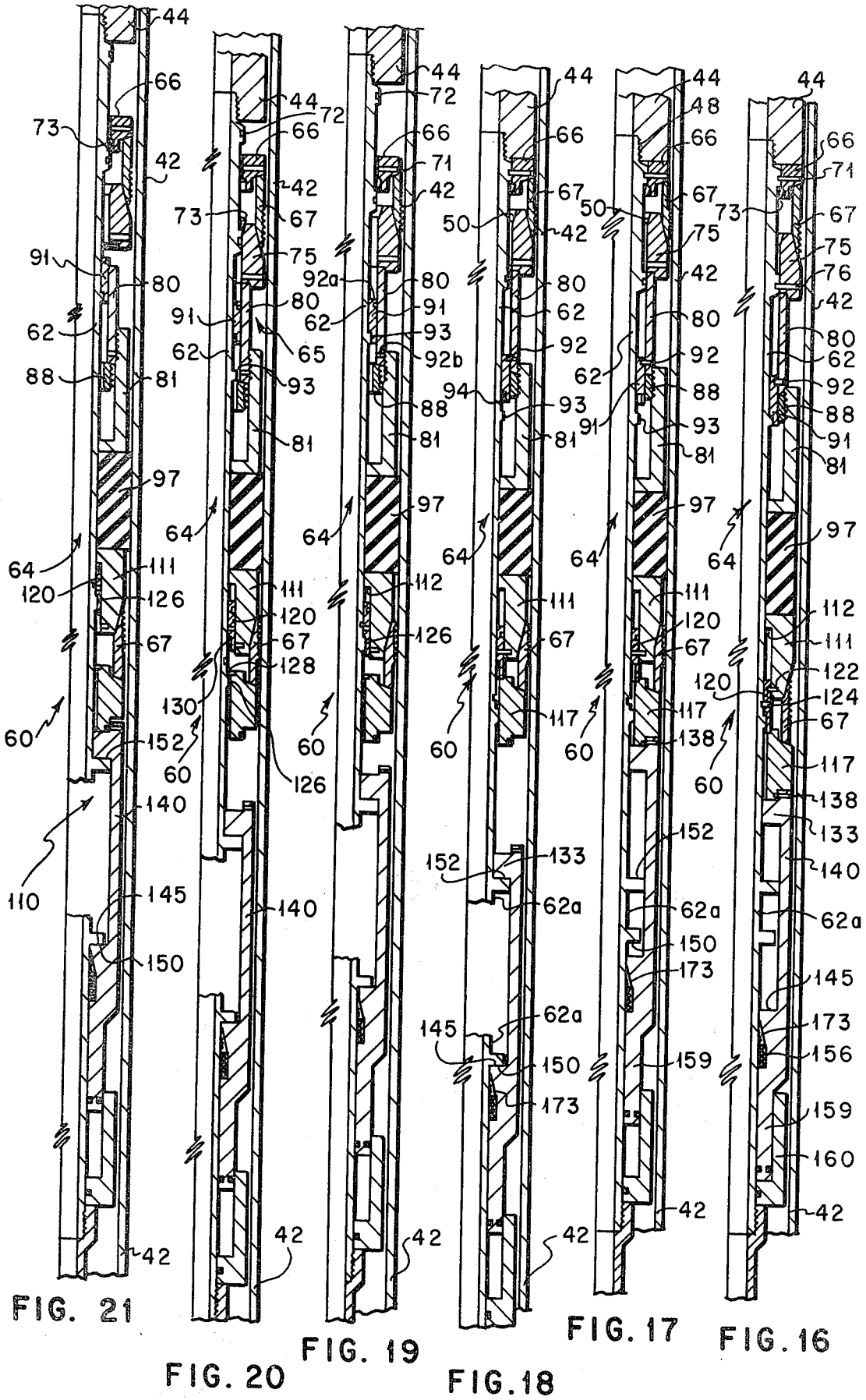
FIG. 16 is a schematic drawing partially in section with portions broken away showing a well packer similar to the packer of FIGS. 3A–F being lowered through a casing string.
FIG. 17 is a schematic drawing partially in section with portions broken away showing the well packer of FIG. 16 set within the casing string.
FIG. 18 is a schematic drawing partially in section with portions broken away showing the well packer of FIG. 16 after the mandrel means has been cut to release the lower body means.
FIG. 19 is a schematic drawing partially in section with portions broken away showing the well packer of FIG. 16 after the mandrel means has been raised to shift the locking sleeve or cylinder of the upper body means.
FIG. 20 is a schematic drawing partially in section with portions broken away showing the well packer of FIG. 16 after the mandrel means has been lowered to disengage the retaining cylinder.
FIG. 21 is a schematic drawing partially in section with portions broken away showing the well packer of FIG. 16 being removed from the casing string.

Upper slip carrier 66 also carries an internal slip ring or c-ring 73 adjacent to each mandrel means 61 and 62. Beveled cam surfaces are provided on the interior of slip carrier 66 to activate internal slip 73 causing them to ride against or contact the adjacent mandrel means 61 or 62. Teeth 74 are formed on each slip 73 to engage the exterior of the adjacent mandrel means 61 or 62 allowing longitudinal movement of the mandrel means in only one direction with respect to internal slips 73. As will be explained later, internal slips 73 perform an important function in the release of upper body means 65 from its set portion. Slip expander 75 is releasably secured by shear screws 76 to the exterior of mandrel means 61 and 62 spaced longitudinally from slip carrier 66. As shown in FIGS. 3B, 3C and 4A, this defines the first or retracted position for the anchoring means of upper body means 65. Slip expander 75 has tapered surfaces 77 adjacent to each slip element 67. When sufficient force is applied to slip expander 75, screws 76 will shear allowing slip expander 75 to move longitudinally towards slip carrier 66. Tapered surfaces 77 cause slip elements 67 to radially expand during this longitudinal movement and to engage the interior of casing string 42 as shown in FIG. 17. Slip elements 67, slip carrier 66 and slip expander 75 cooperate to provide an anchoring means carried by upper body means 65 which is engageable with the interior of casing string 42 to prevent longitudinal movement of body means 65 relative thereto. Bolts 78 are provided for use during assembly of packer 60 and to define the maximum longitudinal distance slip expander 75 can move away from slip carrier 66. Bolts 78 also assist with the removal of packer 60 after it has released from its set position. Beveled cam surfaces 50 are provided on the interior of slip expander 75 adjacent to each mandrel means 61 and 62. Surfaces 50 are sized to receive internal slip ring 73. Slip carrier 66 and the c-ring configuration of slips 73 hold internal slips 73 in contact with mandrel means 61 and 62 while packer 60 is lowered into casing string 42 and set at a desired downhole location. Slip expander 75 via surfaces 50 holds internal slips 73 in contact with mandrel means 61 and 62 during the release of packer 60 from its set position if downward force must be applied to slip expander 75.

First cylinder 80 surrounds mandrel means 61 and 62 and abuts slip expander 75. Flange 82 is formed on the exterior of first cylinder 80 to provide a shoulder for slip expander 75 to rest on. Second cylinder 81 surrounds mandrel means 61 and 62 adjacent to first cylinder 80. The outside diameter of first cylinder 80 is sized to telescope within the inside diameter of second cylinder 81. Retainer plate 83 is provided at the end of the second cylinder 81 opposite from first cylinder 80. Retainer plate 83 is basically a solid disc with two openings 85 and 86 for mandrel means 61 and 62 to respectively slide through. A circumferential rim 84 is provided on the exterior of plate 83 to receive the end of second cylinder 81.

Figure 7:
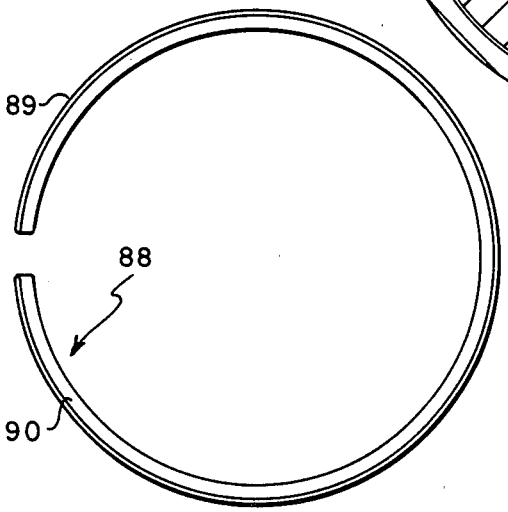
FIG. 7 is a plan view of the retaining cylinder which blocks the first and second cylinders of the upper body means from telescoping relative to each other.
Figure 8:
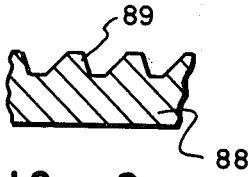
FIG. 8 is an enlarged fragmentary view in section showing the threads on the exterior of the retaining cylinder which releasably engage matching threads on the interior of the second cylinder.
Figure 9:
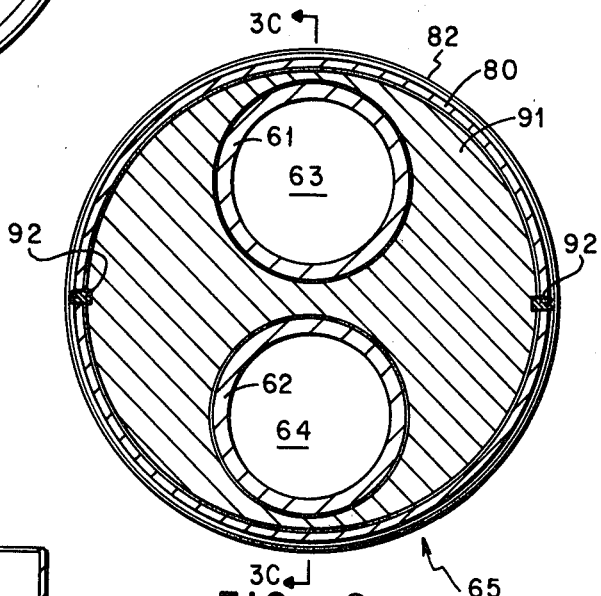
FIG. 9 is a drawing in section taken along line 9—9 of FIGS. 3C and 4A.
Figure 10:
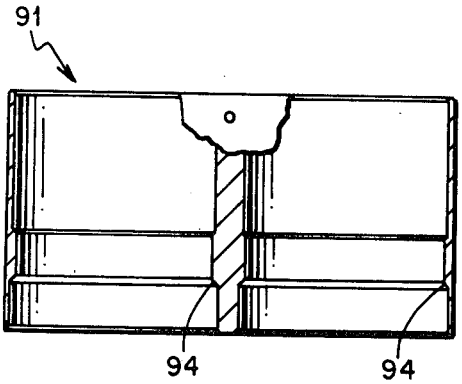
FIG. 10 is a drawing partially in section and elevation of the locking sleeve used in the upper body means.

Teeth or grooves 89 are formed on the inside diameter of second cylinder 81 near the end which receives first cylinder 80. Retaining cylinder 88 is disposed within second cylinder 81 and has matching teeth or grooves 89 to engage teeth 87. A portion of retaining cylinder 88 is cut away as best shown in FIG. 7 which allows cylinder 88 to function similar to a snap ring or c-ring. Also, the pitch of teeth 87 and 89, as best shown in FIG. 8, is selected so that when force is applied to end 90 of cylinder 88, teeth 87 and 89 will ratchet over each other if cylinder 88 can flex inwardly.

Normally, locking sleeve 91 is positioned between mandrel means 61 and 62 and retaining cylinder 88 to prevent inward flexing of cylinder 88. Shear pins 92 are provided to releasably secure locking sleeve 91 to first cylinder 80 and to maintain locking sleeve 91 positioned behind retaining cylinder 88. As best shown in FIG. 3C, retaining cylinder 88 prevents first cylinder 80 from telescoping relative to second cylinder 81 as long as teeth 87 and 89 are engaged.

Snap rings 93 are secured to the exterior of each mandrel means 61 and 62 in appropriately sized grooves adjacent to locking sleeve 91. Shoulders 94 are provided on the interior of locking sleeve 91 adjacent to snap rings 93. As will be explained later, snap rings 93 engage shoulders 94 to lift or remove locking sleeve 91 from behind retaining cylinder 88. First cylinder 80 and second cylinder 81 cooperate to provide a support for slip expander 75 and prevent slip expander 75 from moving longitudinally away from slip carrier 66 until after retaining cylinder 88 has been released from teeth 87.

Packing means 97 are carried on the exterior of mandrel means 61 and 62 between upper body means 65 and lower body means 110. Packing means 97 are preferably molded from elastomeric material. When upper body means 65 and lower body means 110 are moved longitudinally towards each other, this longitudinal movement causes compression and radial expansion of packing means 97 to form a fluid barrier with the interior of casing string 42 as shown in FIG. 1. For packer 60, packing means 97 consists of three separate elastomeric elements. However, other configurations for packing means 97 can be readily used.

Lower body means 110 is carried on the exterior of mandrel means 61 and 62 and is releasably secured thereto. Lower body means 110 includes several subassemblies which are generally cylindrical and slidable with respect to each other and mandrel means 61 and 62. Various components of lower body means 110 are interchangeable with components of upper body means 65 and have the same number such as slip elements 67.

Lower slip expander 111 is the portion of lower body means 110 immediately adjacent to packing means 97. Parallel bores 113 and 114 extend longitudinally through slip expander 111 to receive mandrel means 61 and 62 respectively therein. Shoulder or rim 112 is formed on the interior of each bore 113 and 114 near the end adjacent to packing means 97. Shoulders 112 are used to support the weight of lower body means 110 and the lower portions of tubing strings 40 and 41 while removing packer 60 from casing 42.

Figure 12:
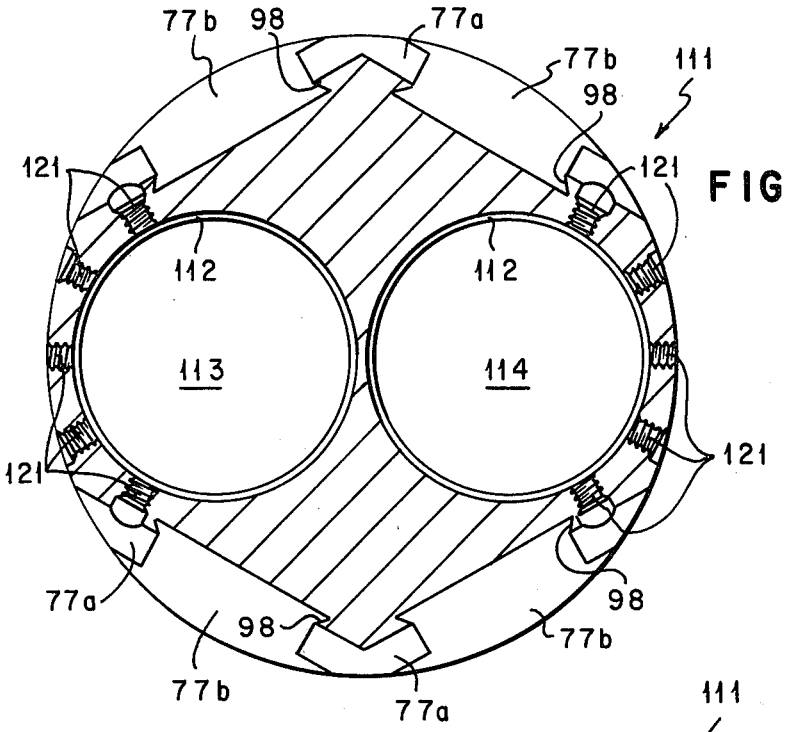
FIGS. 12 is a drawing in section taken along line 12—12 of FIG. 11.
Figure 11:
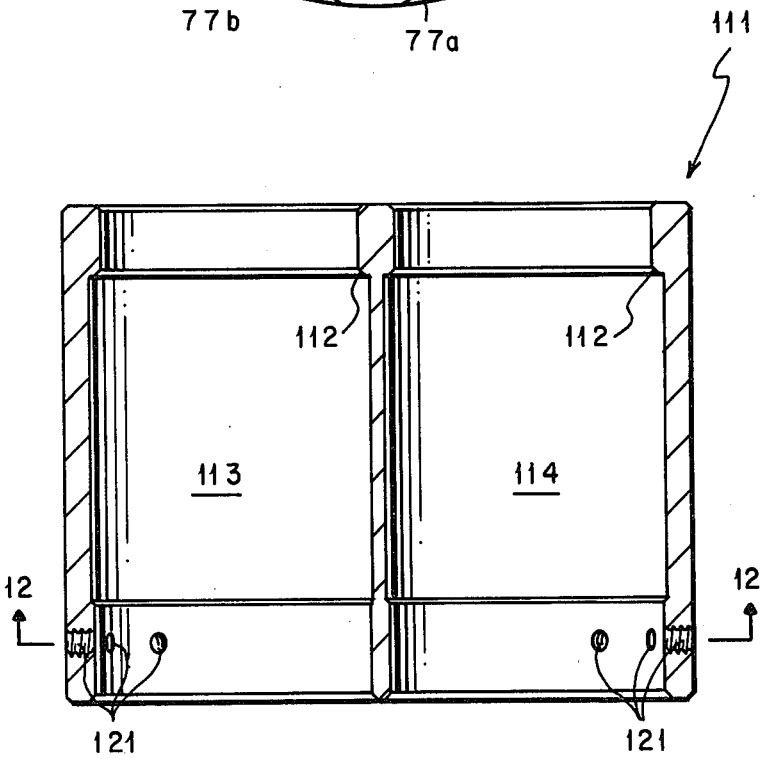
FIG. 11 is a drawing in longitudinal section of the slip expander of the lower body means.
Figure 13:
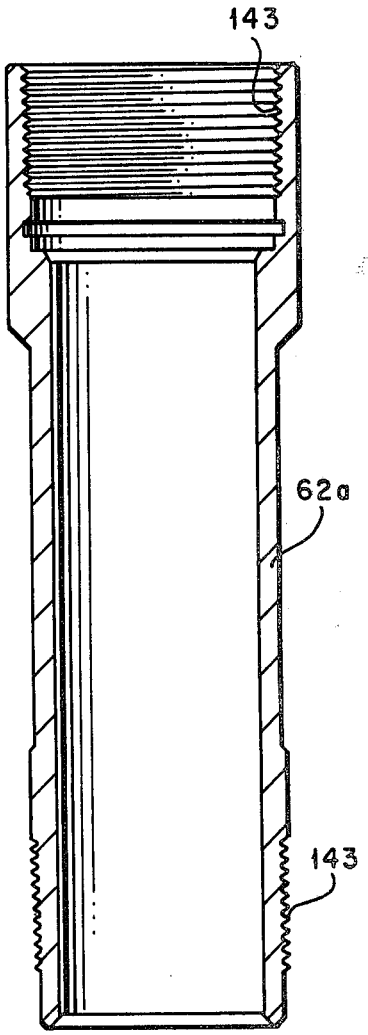
FIG. 13 is a drawing in longitudinal section of the portion of the mandrel means which can be cut to release the lower body means.
Figure 14:
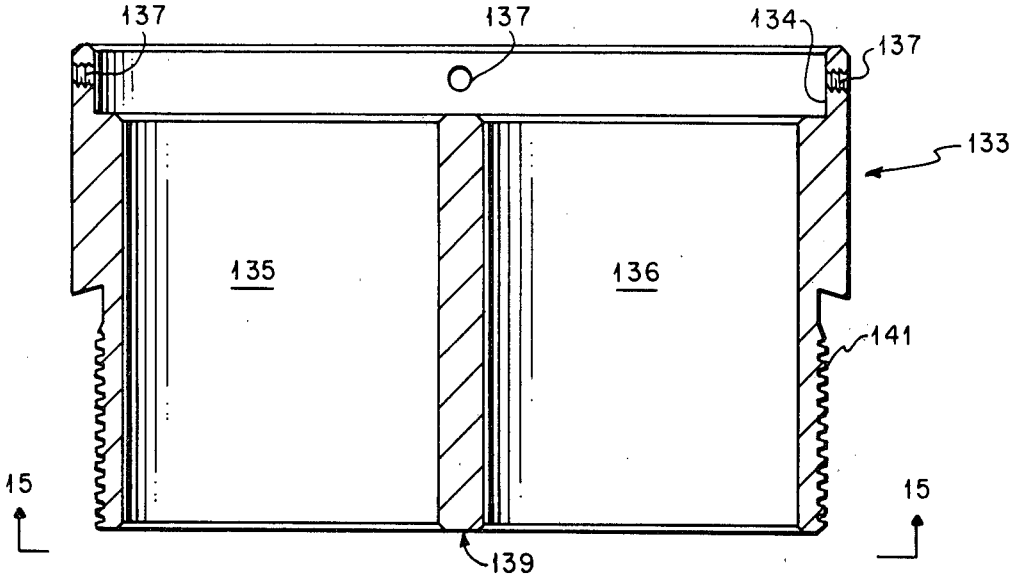
FIG. 14 is a drawing in longitudinal section of the lower body means adapter sub.
Figure 15:
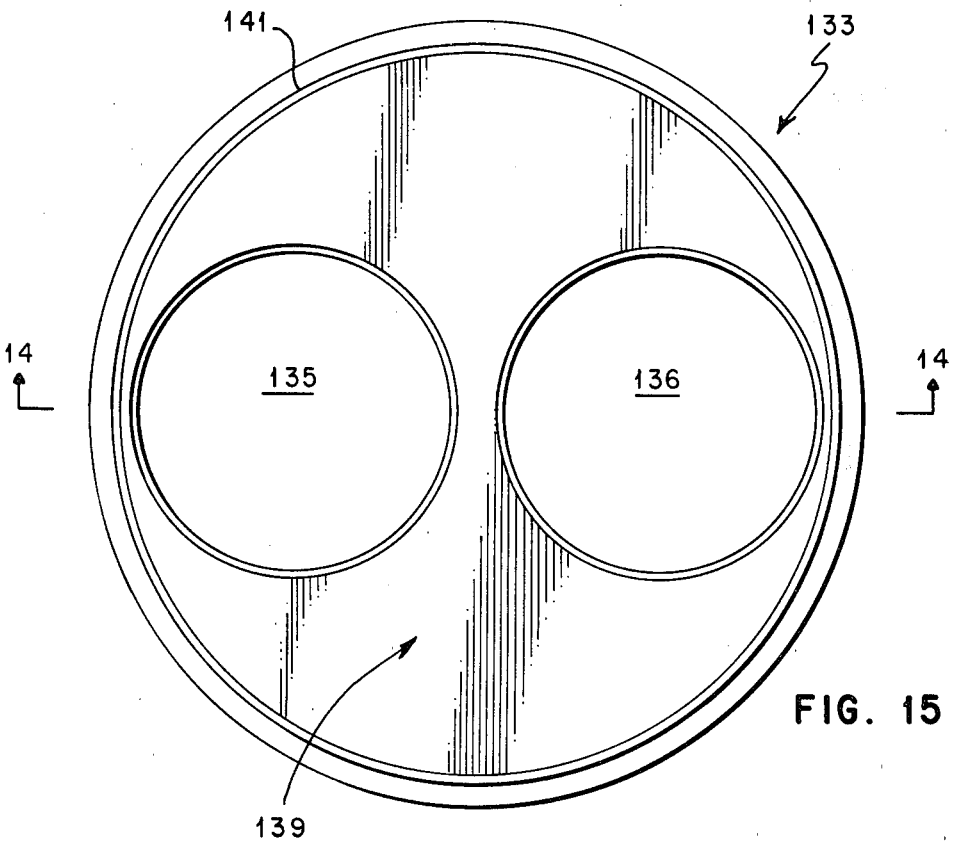
FIG. 15 is a plan view of the lower body means adapter sub shown in FIG. 14.

As best in FIG. 12, surface 77 on lower slip expander 111 actually consists of two parallel tapered surfaces **77*a* and 77*b*. Channels 98 are formed between surfaces 77*a* and 77*b* to guide slip element 67 and to retain close contact between slip elements 67 and lower expander 111 while packer 60 is being both set and released. Surface 77 on upper slip expander 75** has a similar configuration.

Teeth 101 are formed on the exterior of each slip element 67 to engage the inner wall of casing 42. The pitch or angle of teeth 101 is selected such that slips 67 carried by lower body means 111 will prevent packer 60 from moving downwardly (one direction) relative to casing 42. Slip elements 67 of upper body means 65 are carried with their teeth 101 oriented to prevent packer 60 from moving upwardly (the other direction) relative to casing 42 when the upper slip elements are expanded.

Slip carrier 117 has a plurality of external slip elements 67 attached thereto by conventional T-handles 68 and dove-tailed slots 69. Separation cylinders 119 and 120 are disposed around mandrel means 61 and 62 respectively between slip expander 111 and slip carrier 117 to prevent undesired longitudinal movement of expander 111 toward carrier 117. Cylinders 119 and 120 are sized to be received respectively within bores 113 and 114 of expander 111.

Figure 3D:
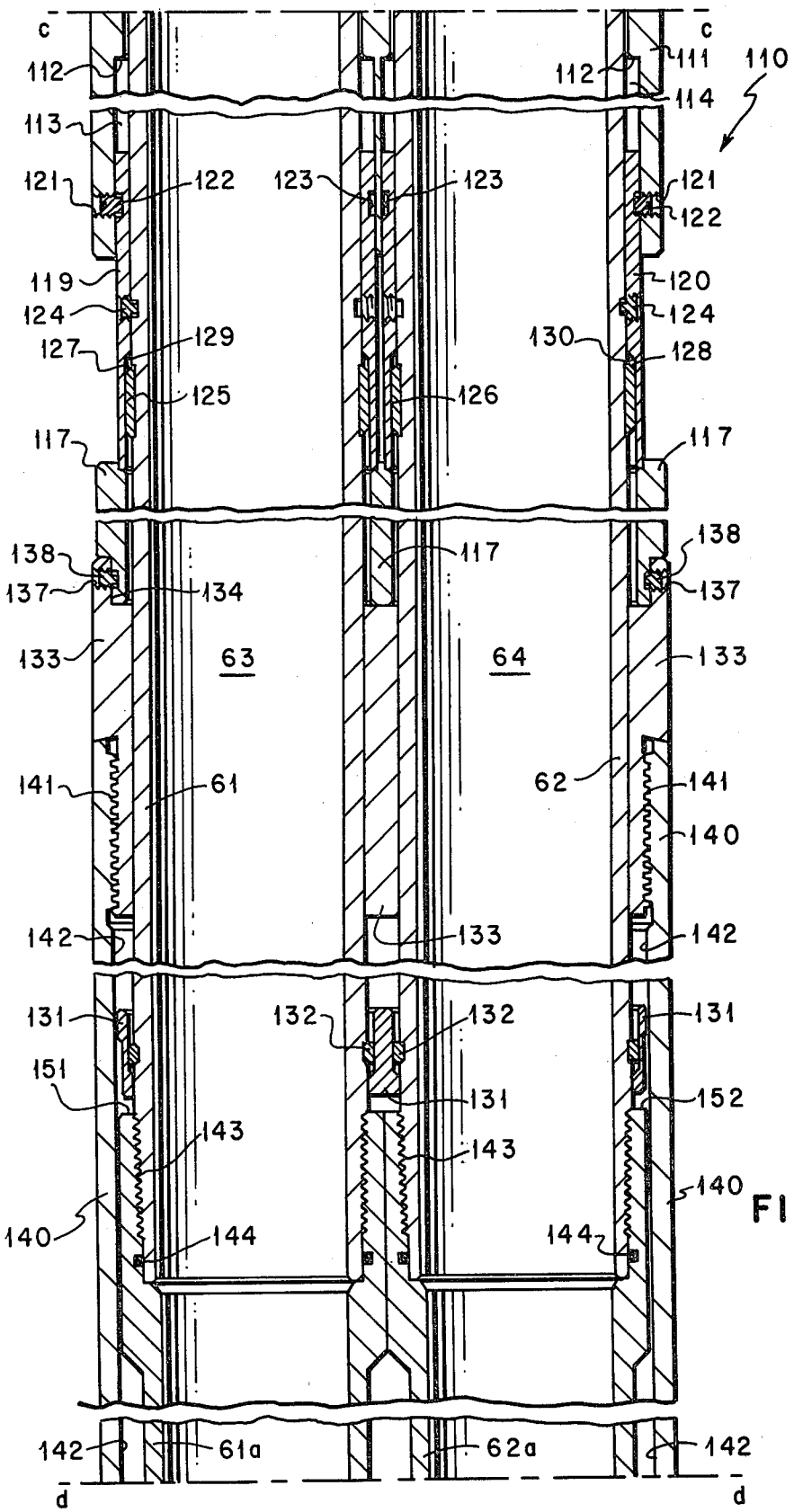
Figure 3E:
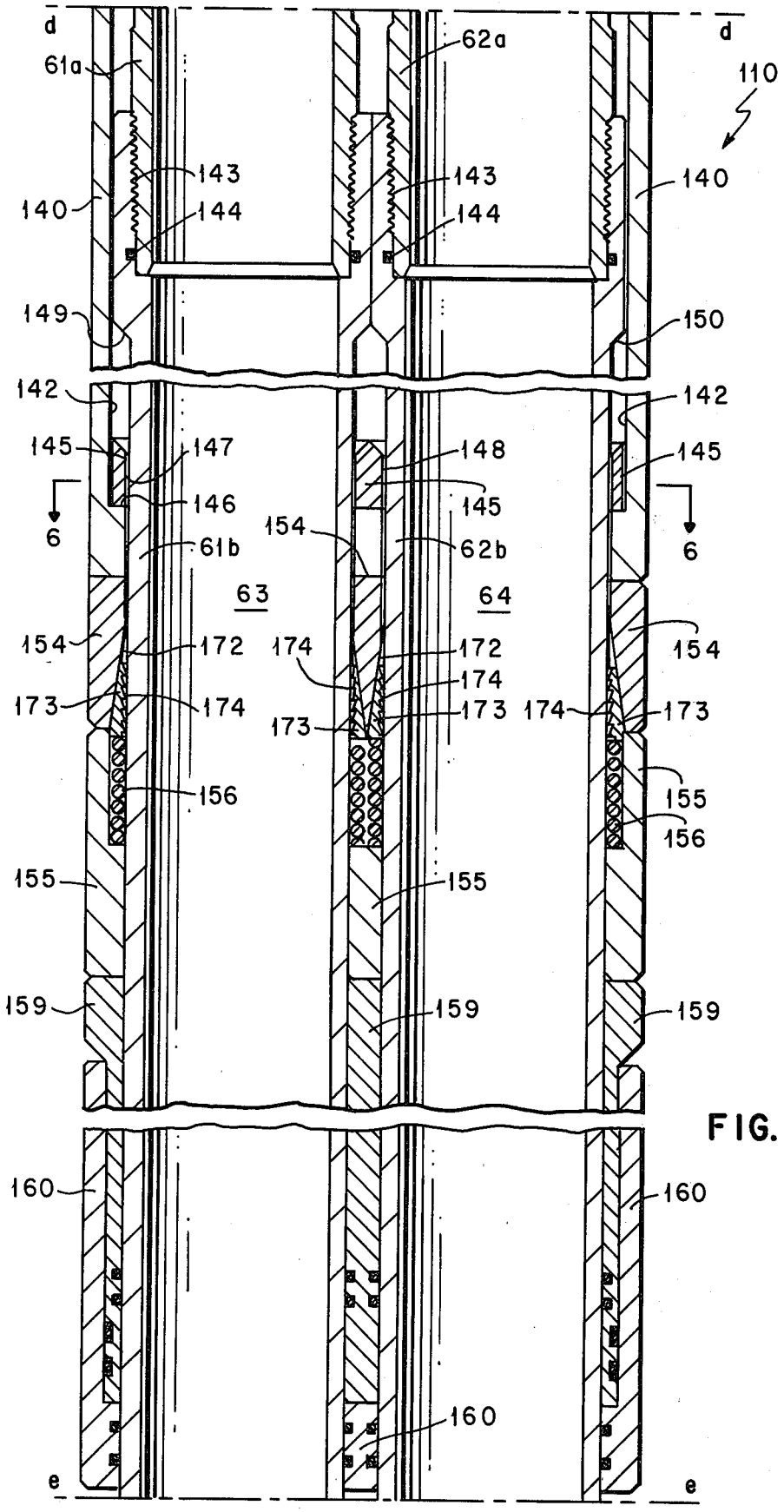
Figure 3F:
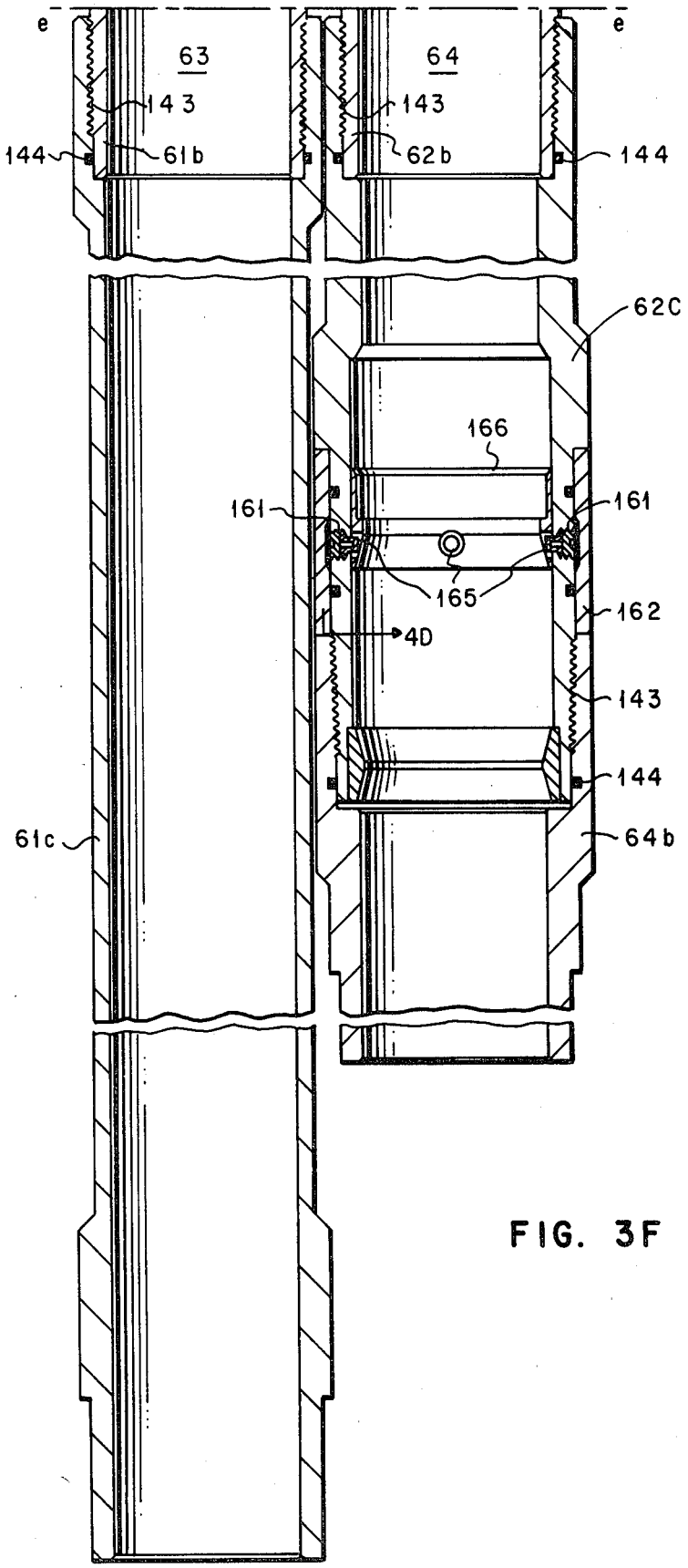

A plurality of screw holes 121 is provided through the exterior of slip expander 111 into each bore 113 and 114 to allow insertion of shear screws 122 therein. Suitable annular grooves 123 are provided in the exterior of each separation cylinder 119 and 120 to receive the extreme end of shear screws 122. As shown in FIG. 3D, shear screws 122 releasably secure cylinders 119 and 120 to slip expander 111. Cylinders 119 and 120 prevent longitudinal movement of slip expander 111 and slip carrier 117 towards each other until after screws 122 have been sheared.

Separation cylinders 119 and 120 are also releasably secured to their respective mandrel means 61 and 62 by shear screws 124. Snap rings 125 and 126 are carried on the exterior of mandrel means 61 and 62 respectively to provide shoulders 127 and 128. Opposing shoulders 129 and 130 are formed on the interior of cylinders 119 and 120 respectively. Opposing shoulder 127 contacts shoulder 129 and opposing shoulder 128 contacts shoulder 130 when packer 60 is removed from casing 42.

Figure 4B:
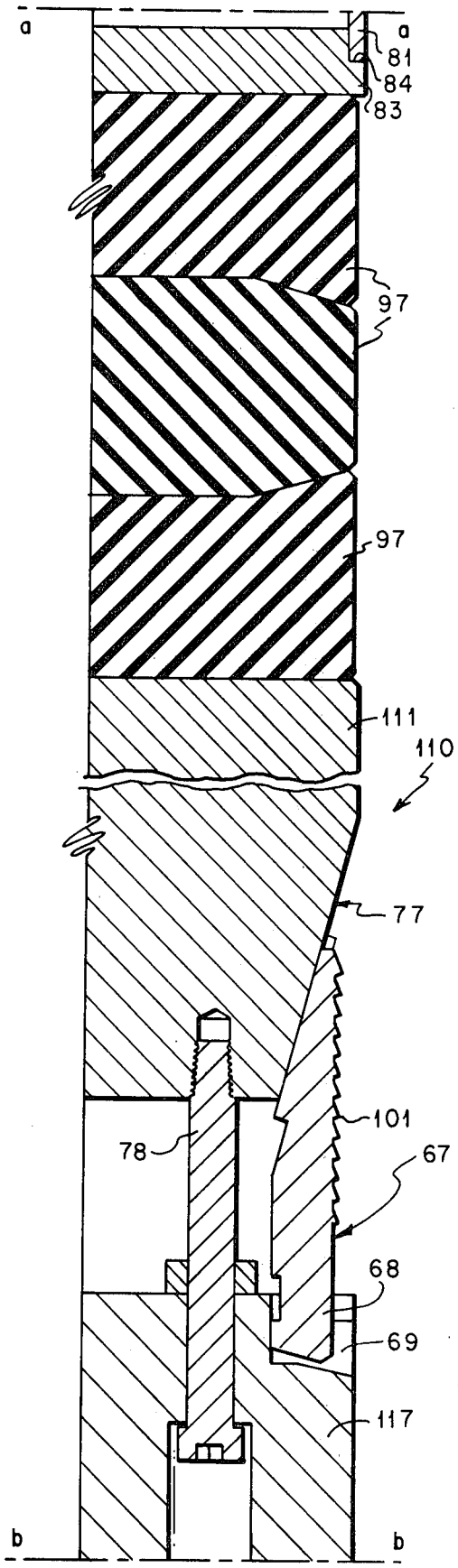

When sufficient force is applied to slip carrier 117, pins 122 will shear allowing cylinders 119 and 120 to slide within their respective bores 113 and 114. Slip carrier 117 can then move longitudinally towards slip expander 111 to radially expand slip elements 67. Slip expander 111, slip elements 67, and slip carrier 117 cooperate to provide an anchoring means carried by lower body means 110 which is engageable with the interior of casing string 42 to prevent longitudinal movement of body means 110 relative thereto. The first or retracted position for the anchoring means of lower body means 110 is shown in FIGS. 3D and 4B. Bolts 78 are used for the same function within lower body means 110 as in upper body means 65.

Adapter sub 133 is used to connect lower slip carrier 117 to release support cylinder 140. Adapter sub 133 is formed from a relatively short solid cylinder by machining parallel bores 135 and 136 therethrough. Mandrel means 61 and 62 are slidably disposed within the respective bores 135 and 136. Counter bore 134 is machined in one end of adapter sub 133 to receive a portion of slip carrier 117 therein. Holes 137 extend through the exterior of adapter sub 133 and communicate with counter bore 134. Shear screws 138 are positioned within each hole 137 to secure the attachment of expander 117 to adapter sub 133.

Matching threads 141 on the exterior of adapter sub 133 and the interior of release support cylinder 140 are used to attach these two components to each other. Cylinder 140 is a relatively long hollow sleeve with a single bore 142 therethrough. The inside diameter of bore 142 is larger than the sum of the outside diameters of mandrel means 61 and 62. Fluid dampening plate 131 is secured by snap rings 132 to mandrel means 61 and 62 between adapter sub 133 and mandrel sections **61*a* and 62*a*. The outside diameter of dampening plate 131 is slightly less than the inside diameter of bore 142. Therefore, dampening plate 131 restricts fluid flow within bore 142 whenever mandrel means 61 and 62 move longitudinally relative to release support cylinder 140**.

Mandrel sections **61*a* and 62*a* are disposed within release support cylinder 140 and are critical components for releasing packer 60 from casing string 42. Stop plate 145 is positioned within release support cylinder 140 and rests on internal flange 146. Plate 145 has bores 147 and 148 with mandrel sections 61*b* and 62*b* slidably disposed therethrough. Shoulders 149 and 150 are formed by the upsets at threaded connections 143 between mandrel sections 61*a* and 61*b* and mandrel sections 62*a* and 62*b* respectively. Bores 147 and 148 are sized to prevent shoulders 149 and 150 from sliding therethrough. Shoulders 151 and 152 are formed on the exterior of mandrel means 61 and 62 by the upsets at threaded connections 143 between mandrel 61 and 61*a* and mandrel sections 62 and 62*a*. Shoulders 149, 150, 151 and 152 are important components for releasing packer 60 from casing 42**.

Lower internal slip housing 154 surrounds mandrel means 61 and 62 adjacent to release support cylinder 140. A plurality of internal slip segments 173 is carried within housing 154 adjacent to each mandrel means 61 and 62. Beveled cam surfaces 172 provided on the interior of housing 154 activate internal slips 173 causing them to ride against or contact the adjacent mandrel means 61 or 62. Teeth 174 are formed on each slip 173 at an angle which allows movement of mandrel means 61 and 62 in only one direction relative to slips 173.

Figure 2A:
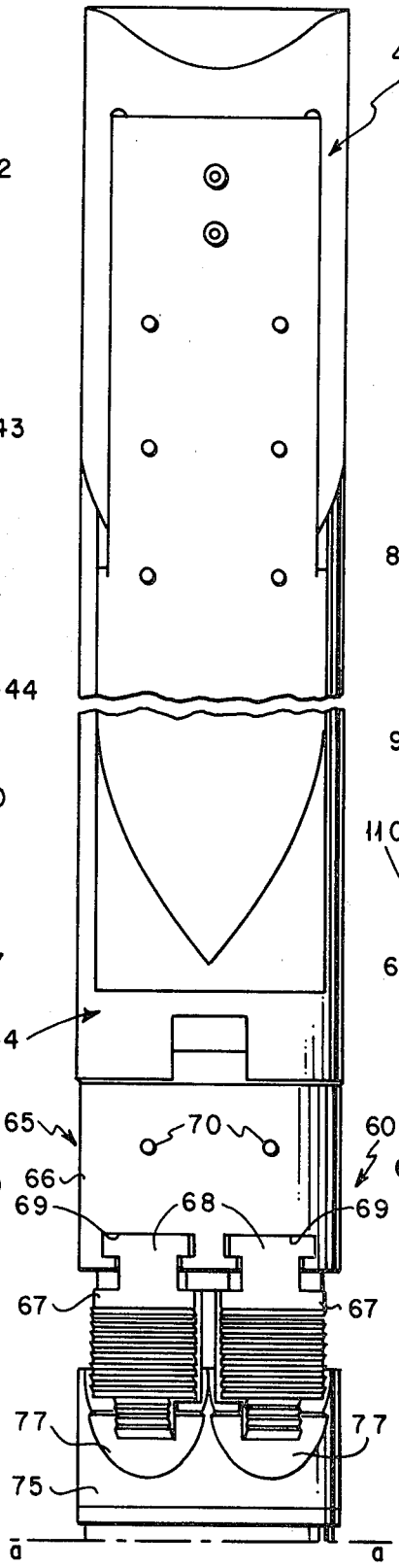
FIGS. 2A, B, C and D are drawings in elevation with portions broken away showing the exterior of a well packer incorporating the present invention.
Figure 2B:
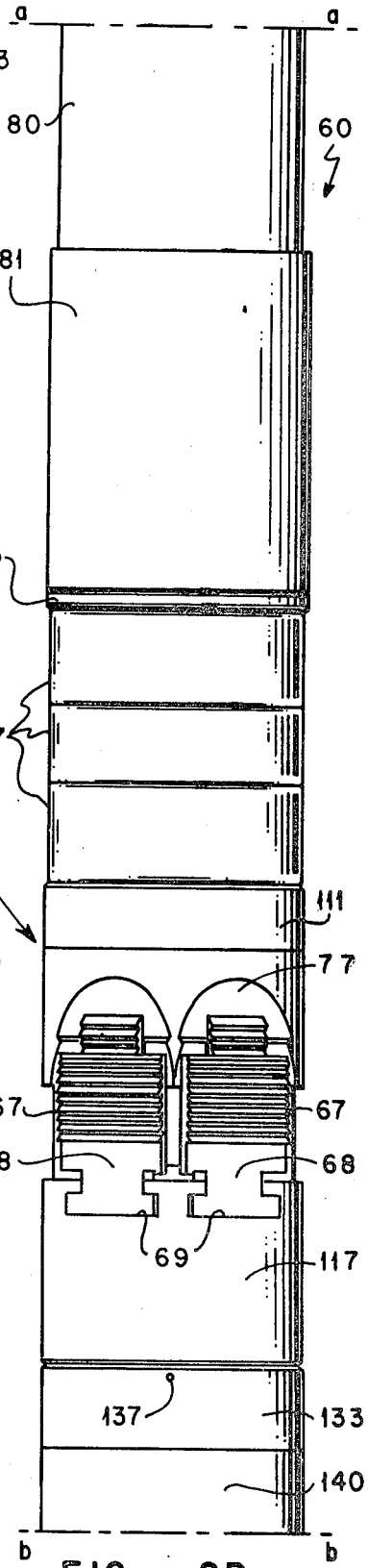
Figure 2C:
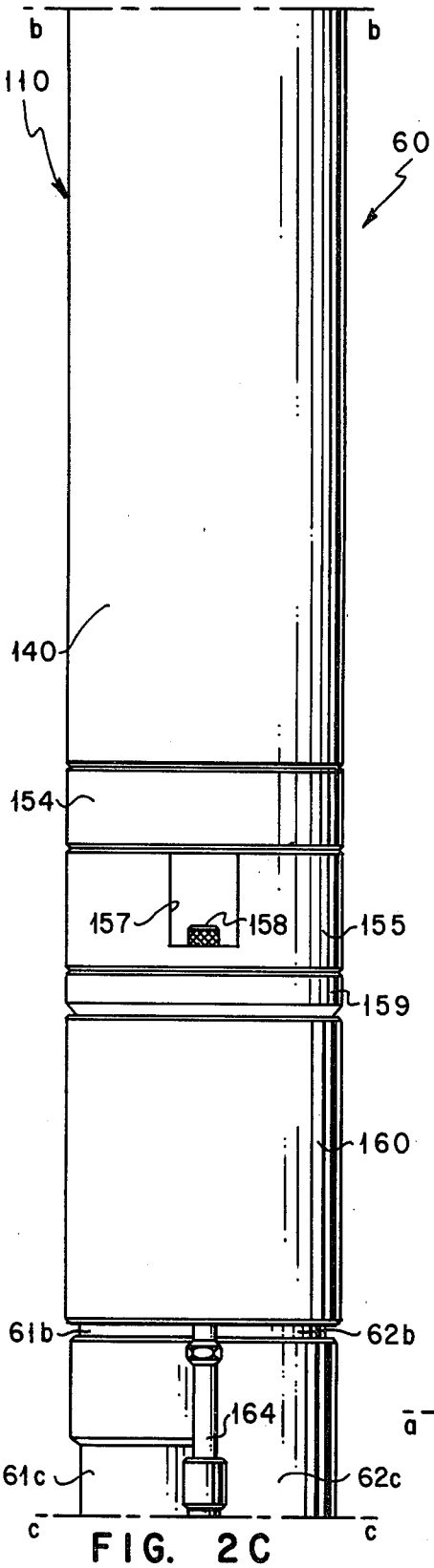
Figure 2D:
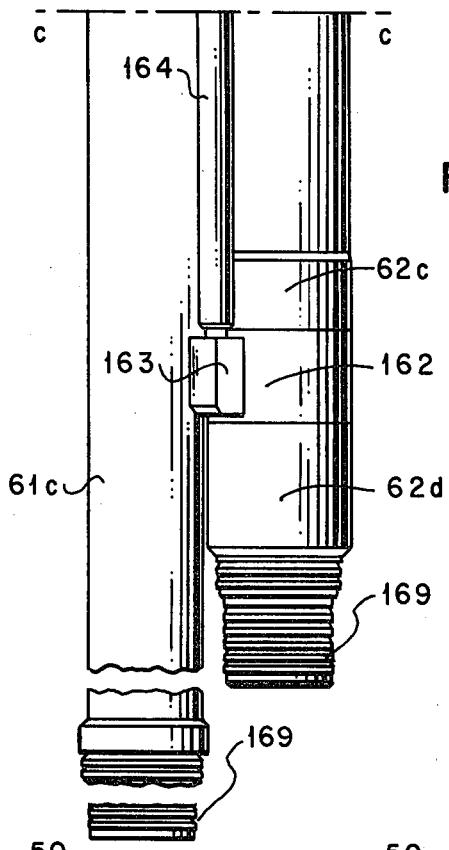
Figure 4C:
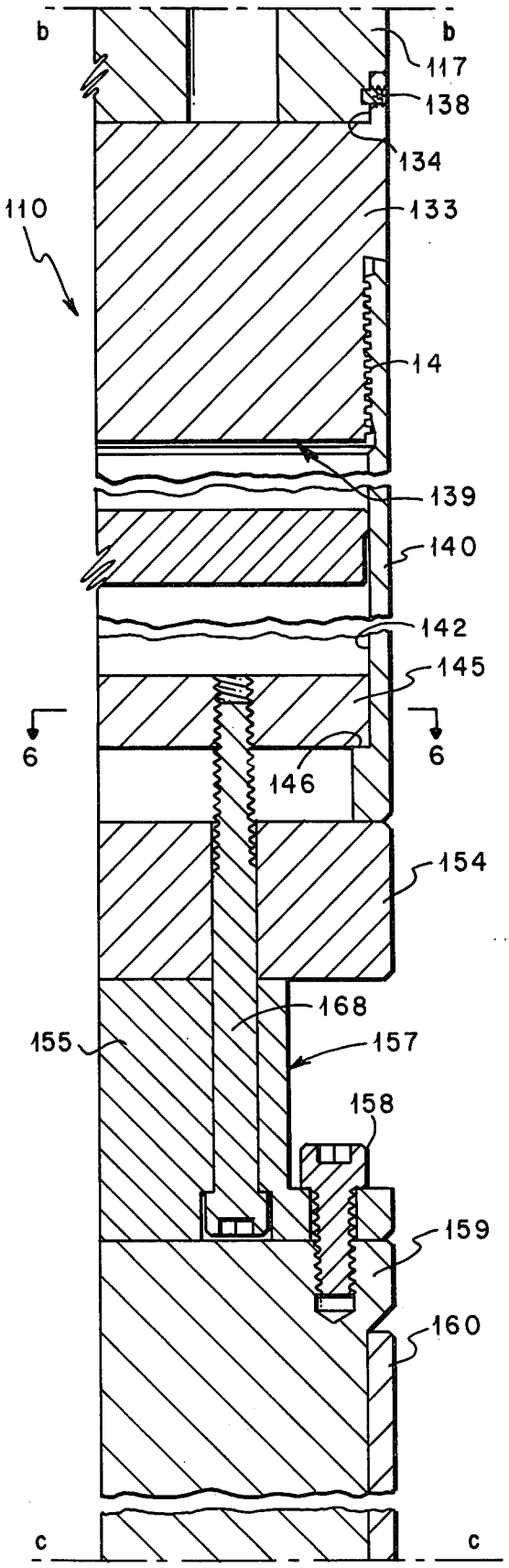
Figure 4D:
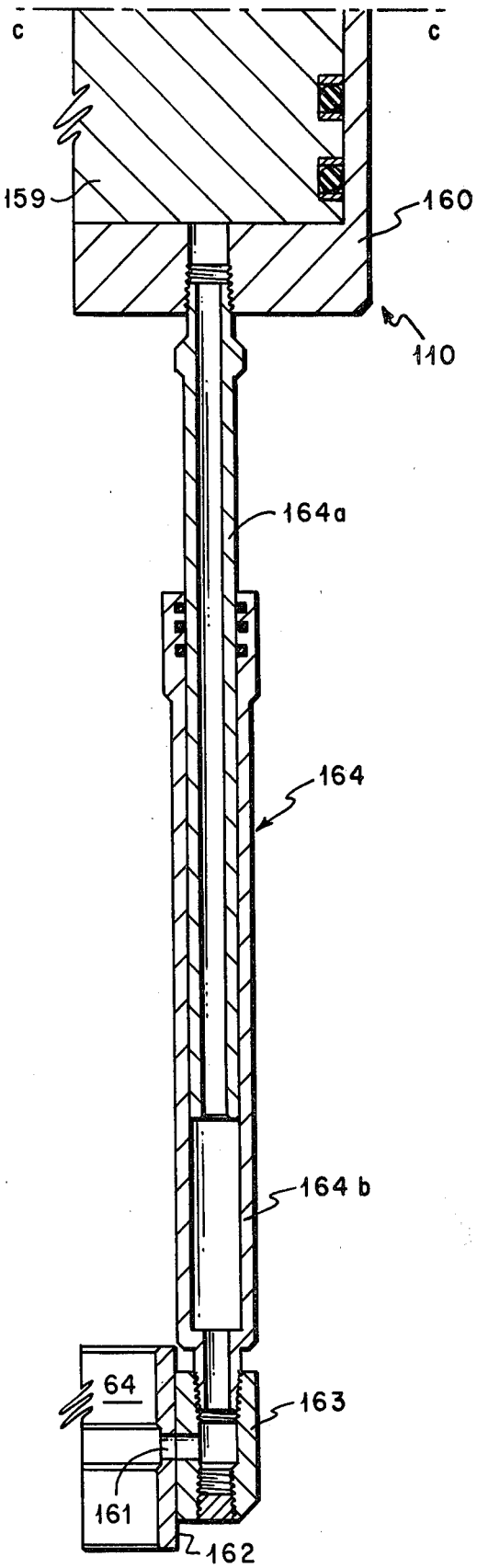

Lower spring housing 155 surrounds mandrel means 61 and 62 adjacent to slip housing 154. Springs 156 are disposed therein and surround each mandrel means 61 and 62. Springs 156 contact slip segments 173 and bias them against cam surface 172. Windows 157, as shown in FIGS. 2C and 4C, are machined partially through the exterior of spring housing 155. Bolts 158 are inserted through windows 157 to secure spring housing 155 to piston 159.

Piston 159 and piston housing 160 are carried on mandrel means 61 and 62 and cooperate to provide a piston means for moving lower body means 110 longitudinally towards upper body means 65 in response to fluid pressure in passageway 64. This longitudinal movement causes radial expansion of slips 67 and compression of packing means 97. Internal slips 173, springs 156 and slip housing 154 provide means for locking lower body means 110 to mandrel means 61 and 62 after completion of the longitudinal movement whereby packing means 97 are maintained compressed and slips 67 on both upper body means 65 and lower body means 110 are maintained radially expanded.

Ports 161 extend radially through mandrel section **62*c* and sleeve 162 which surrounds the exterior of mandrel section 62*c*. Sleeve 162 is secured to section 62*c* by the engagement between sections 62*c* and 62*d*. Boss 163 is attached to the exterior of sleeve 162 to communicate fluid between ports 161 and connecting tube or conduit 164. Connecting tube 164 is formed from two hollow tubes 164*a* and 164*b* which can telescope within each other. Tube 164*a* is attached to piston housing 160. Tube 164*b* is attached to boss 163. Knockout plugs 165 are threadedly engaged with each port 161 to prevent fluid flow therethrough until after knockout sleeve 166 has been shifted. Various well tools are readily available which can engage sleeve 166 to shear the end of plugs 65 to open fluid communication between ports 161 and piston 159**.

Bolts 168 which extend through spring housing 155, slip housing 154, support cylinder 140 and stop plate 145 securely abut these components to each other. Bolts 158 and 168 cooperate to transfer longitudinal movement of piston 159 to lower body means 110.

Threads 169 are provided on the extreme end of mandrel sections **61*c* and 62*d* to connect the lower portions of tubing strings 41 and 40** thereto.

Operating Sequence

FIGS. 16 through 21 show the operating sequence of the various components within packer 60 as it is lowered through casing 42, set or anchored at a desired downhole location, and then released from casing 42. The components shown in FIGS. 16 through 21 are in schematic form only. The same numerical designations are used to allow correlation between the schematic representation of a component and its more detailed construction shown in the other figures. Only mandrel means 62 and its associated components will be discussed. FIGS. 16 through 21 demonstrate that the present invention could be used with a packer having a single mandrel means as well as a packer having dual mandrel means.

In FIG. 16, the components of packer 60 are shown as they would appear while packer 60 was lowered through the bore of casing string 42. A suitable running tool (not shown) would be attached to orienting body 44. Shear screws 71 and 76 releasably secure upper slip carrier 66 and slip expander 75 on the exterior of mandrel means 62 spaced longitudinally from each other with slip elements 67 retracted. Locking sleeve 91 is releasably positioned behind retaining cylinder 88 by shear pins 92. Retaining cylinder 88 in turn prevents first cylinder 80 from telescoping within second cylinder 81. Packing means 97 are relaxed.

Lower slip carrier 117 is releasably spaced from lower slip expander 111 by separation cylinder 120 to maintain slip elements 67 retracted. Shear screws 122 secure cylinder 120 to slip expander 111, and shear screws 124 secure cylinder 120 to mandrel means 62. Shear screws 124 provide a first releasable means for securing lower body means 110 to mandrel means 62. Adapter sub 133 and release support cylinder 140 (shown as a single component in FIGS. 16–21) are attached to lower slip carrier 117 by shear screws 138.

After packer 60 has been lowered to the desired downhole location, a suitable wireline tool can be used to shift sleeve 166, thereby opening a fluid communication path from passageway 64 to piston means 159 via ports 161. Fluid pressure within passageway 64 can then be increased to apply force to lower body means 110 by piston 159. Shear screws 124 are selected to release lower body means 110 from mandrel means 62 when fluid pressure acting upon piston 159 exceeds a first preselected value. After screws 124 are sheared, the force generated by piston means 159 is transmitted to packing means 97 and upper body means 65 via lower body means 110 and packing means 97. Shear screws 76 can be selected to have a shear value greater than the shear value of shear screws 124. Thus, force generated by piston 159 will shear screws 76 to release upper slip expander 75 from mandrel means 62 after screws 124 have been sheared. This same force causes slip expander 75 to move longitudinally towards slip carrier 66 and radially expand slip elements 67 until they engage casing string 42. During this radial expansion of slip elements 67, slip carrier 66 is firmly abutted against orienting body 44 which is threadedly engaged with mandrel means 62.

Prior to slip elements 67 on upper body means 65 being engaged with the interior of casing string 42, fluid pressure acting on piston 159 tends to compress and radially expand packing means 97 between upper body means 65 and lower body means 110. The shear value of shear screws 122 is selected to allow the fluid acting on piston 159 to exceed a second preselected value prior to shearing screws 122. This second preselected fluid pressure corresponds to the force required to compress packing means 97 to form a fluid tight barrier between the exterior of mandrel means 62 and the interior of casing string 42. After screws 122 have been sheared, lower slip carrier 117 can slide longitudinally towards lower slip expander 111 to radially expand slip elements 67 and engage them with the interior of casing string 42 as shown in FIG. 17. Thus, lower body means 110 is anchored to casing string 42 to hold packing means 97 compressed and radially expanded. In the alternative, lower body means 110 can be anchored to casing string 42 prior to upper body means 65 or concurrent therewith. If fluid pressure within passageway 64 continues to increase above this second preselected value, the additional force generated by piston means 159 causes slip elements 67 of lower body means 110 to more securely engage casing string 42. When packer 60 is anchored to the interior of casing string 42 as shown in FIG. 17, packer 60 will resist both tension and compression forces from tubing strings 40 and 41. Packing means 97 will also seal against differences in fluid pressure in either direction within casing 42. Packer 60 can remain in this position indefinitely.

As the well conditions change, it may be necessary to remove packer 60 from its downhole location. A standard wireline locking mandrel or well tool with a tubing cutting tool attached (not shown) can be lowered through tubing string 40 and secured within locator recess or profiles 47 of orienting head assembly 43. A locking mandrel satisfactory for engagement with profiles 47 is shown in Composite Catalog of Oil Field Equipment and Services 34th Revision (1980–81) Volume 4 page 5972. Various types of tubing cutting tools are shown in this same catalog on page 6085. The length of the locking mandrel and tubing cutting tool is selected such that the cutting tool will be disposed within mandrel section **62*a* between shoulder 152 and 150 when the locking mandrel is positioned within profiles 47. Various mechanical, chemical, and explosive tubing cutters are commercially available for use with the present invention. Profiles 47 and mandrel sections 61*a* and 62*a* cooperate to provide means for releasing mandrel means 61 and 62 from internal slips 173**.

When mandrel section **62*a* is cut, the lower portions of tubing strings 40 and 41 drop, causing shoulder 150 and 145 to contact each other. This transfers the weight of the lower portion of tubing strings 40 and 41 to screws 138 which are designed to shear, allowing lower slip carrier 117 to separate from adapter sub 133. The lower portion of tubing strings 40 and 41 will then drop further until adapter sub 133 contacts shoulder 152 on mandrel means 62. To slow down or cushion the impact of adapter sub 133 with shoulder 152, dampening plate 131 restricts fluid flow within support cylinder 140**.

The configuration of packer 60 after cutting mandrel section **62*a* is shown in FIG. 18. Prior to this, internal slips 173 prevent mandrel means 62 from moving upwards with respect to the other components of packer 60. After mandrel section 62*a* has been cut (mandrel section 61*a* would also have to be cut in a similar manner), upward tension can be applied to tubing strings 40 and 41 to lift orienting body 44 and the portion of mandrel means 62 attached thereto. This upward tension will shear screws 71 and 92 allowing mandrel means 62 to move longitudinally upward with respect to packing means 97. Teeth 74 on internal slip 73 allow longitudinal movement of mandrel means 62 in this direction. Snap ring 93 provides a shoulder on mandrel means 62 whereby this longitudinal movement of mandrel means 62 lifts locking sleeve 91 from behind retaining cylinder 88. This position for locking sleeve 91 is shown in FIG. 19. After locking sleeve 91 is lifted, retaining cylinder 88 can flex inwardly allowing disengagement of teeth 87 and 89**.

The upward movement of mandrel means 62 results in internal slips 73 engaging the exterior of mandrel means 62 at a new location. By next lowering mandrel means 62, internal slips 73 contact beveled cam surfaces 50 of slip expander 75. Continued lowering of mandrel means **62*a* transmits force via internal slips 73 to slip expander 75 to remove slip expander 75 from behind upper slip elements 67. Internal slips 73 and camming surface 50 cooperate to provide means for moving slip expander 75 longitudinally away from slip carrier 66. Channels 98 on expander 75 cause slips 67 to retract and thus disengage upper body means 65 from its anchored position with the interior of casing string 42. This same engagement between mandrel means 62, internal slips 73, and camming surfaces 50 causes slip expander 75 to abut first cylinder 80 which in turn contacts end 90 of retaining cylinder 88 and disengages retaining cylinder 88 from teeth 89 of second cylinder 81. Thus, first cylinder 80 can now telescope within second cylinder 81 and remove all support for slip expander 75. The above described position for packer 60 is shown in FIG. 20. In this configuration, upper body means 65 has been released from its anchored position, and packing means 97** is no longer held in compression.

Following release of upper body means 65, upward tension is next applied to mandrel means 62 via orienting body 44. Mandrel means 62 is now free to move upward. This upward movement causes internal slip elements 73 to re-engage slip carrier 66 lifting it upwards. Slip ring 126 on mandrel means 62 will contact separation cylinder 120 which in turn contacts lower slip expander 111. Thus, lifting mandrel means 62 will result in removing lower slip expander 111 from behind slip elements 67. Channels 98 cause slip elements 67 to retract which disengages lower body means 110 from its anchored position with the interior of casing string 42. Packer 60 can now be withdrawn from casing string 42. The weight of the lower portion of tubing strings 40 and 41 is carried by shoulders 150 and 152 and release support cylinder 140. The configuration of the various components of packer 60 as it is withdrawn from a casing string 42 is shown in FIG. 21.

In summary, packer 60 is hydraulically set at a downhole location by applying fluid pressure to piston 159. Packer 60 is released from its set position by cutting mandrel section 62*a*. Mandrel means 62 is first lifted to free cylinder 88 from locking sleeve 91. Mandrel means 62 is next lowered to telescope first cylinder 80 into second cylinder 81 and to disengage upper body means 65 from the interior of casing string 42. Finally, mandrel means 62*a* is raised to move slip expander 111 upward and to retract lower slip elements 67. Mandrel means 62*a* can continue moving upwards to withdraw packer 60 from casing string 42.

Alternative Embodiment

A portion of well packer 200 incorporating an alternative embodiment of the present invention is shown in FIG. 22A–D. Some components are interchangeable between packer 60 and packer 200. These components have the same numerical designation. Other components of packer 200, which function in a similar manner to components within packer 60 but are slightly different in design, have the same numerical designation followed by a prime (').

Packer 200 uses the same upper body means 65 as previously described for packer 60. Therefore, only lower body means 201 is shown in FIGS. 22A–D. The major difference between well packer 200 and well packer 60 is that fluid pressure within passageway 64' can be used to release the locking means for lower body means 201 rather than cutting mandrel means 62'.

Figure 22A:
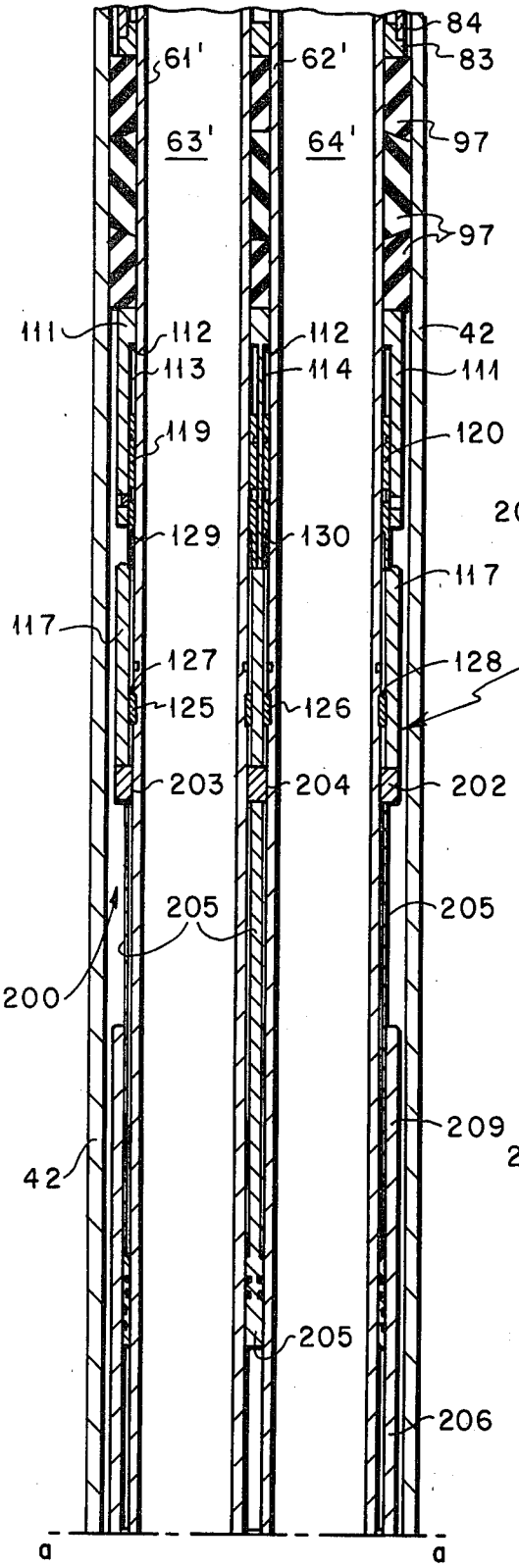
FIGS. 22A, B, C and D are drawings in section with portions broken away showing a well packer incorporating the present invention with an alternative embodiment for releasing the lower body means from its locked or set position.

Packing means 97 are carried on the exterior of mandrel means 61' and 62' between upper body means 65 and lower body means 201. When upper body means 65 and lower body means 201 are moved longitudinally towards each other, this longitudinal movement causes compression and radial expansion of packing means 97 to form a fluid barrier with the interior of casing string 42 as shown in FIG. 22A. For packer 201, packing means 97 consists of three separate elastomeric elements. However, other configurations for packing means 97 can be readily used.

Lower body means 201 is carried on the exterior of mandrel means 61' and 62' and is releasably secured thereto. Lower body means 201 includes several subassemblies which are generally cylindrical and slidable with respect to each other and mandrel means 61' and 62'. Various components of lower body means 201 are interchangeable with components of lower body means 110 and have the same number such as slip elements 67.

Lower slip expander 111 is the portion of lower body means 201 immediately adjacent to packing means 97. Parallel bores 113 and 114 extend longitudinally through slip expander 111 to receive mandrel means 61' and 62' respectively therein. Shoulder or rim 112 is formed on the interior of each bore 113 and 114 near the end adjacent to packing means 97. Shoulders 112 are used to support the weight of lower body means 201 and the lower portions of the tubing string (not shown) while removing packer 200 from casing 42. As previously explained, channels 98 are formed on lower slip expander 111 to retain close contact with slip elements 67 while packer 200 is both being set and released.

Slip carrier 117 has a plurality of external slip elements 67 attached thereto by conventional T-handles 68 and dove-tailed slots 69. Separation cylinders 119 and 120 are disposed around mandrel means 61' and 62' respectively between slip expander 111 and slip carrier 117 to prevent undesired longitudinal movement of expander 111 toward carrier 117. Cylinders 119 and 120 are sized to be received respectively within bores 113 and 114 of expander 111.

A plurality of screw holes 121 is provided through the exterior of slip expander 111 into each bore 113 and 114 to allow insertion of shear screws 122 therein. Suitable annular grooves 123 are provided in the exterior of each separation cylinder 119 and 120 to receive the extreme end of shear screws 122. Shear screws 122 releasably secure cylinders 119 and 120 to slip expander 111. Cylinders 119 and 120 prevent longitudinal movement of slip expander 111 and slip carrier 117 towards each other until after screws 122 have been sheared.

Separation cylinders 119 and 120 are also releasably secured to their respective mandrel means 61' and 62' by shear screws 124. Snap rings 125 and 126 are carried on the exterior of mandrel means 61' and 62' respectively to provide shoulders 127 and 128. Opposing shoulders 129 and 130 are formed on the interior of cylinders 119 and 120 respectively. Opposing shoulder 127 contacts shoulder 129 and opposing shoulder 128 contacts shoulder 130 when packer 200 is removed from casing 42.

Figure 23:
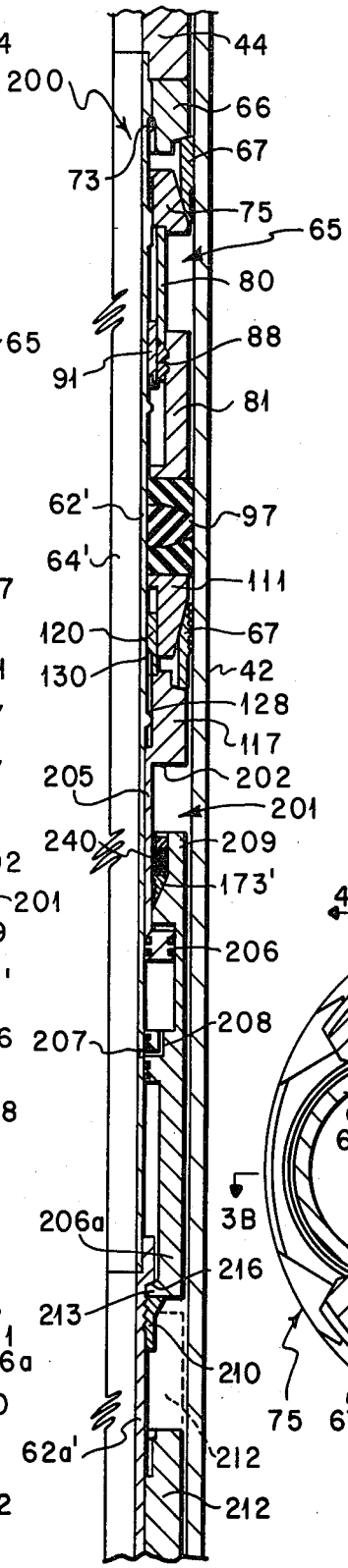
FIG. 23 is a schematic drawing partially in section with portions broken away showing the lower body means of the well packer of FIGS. 22A–D being released from its locked position.
Figure 25:
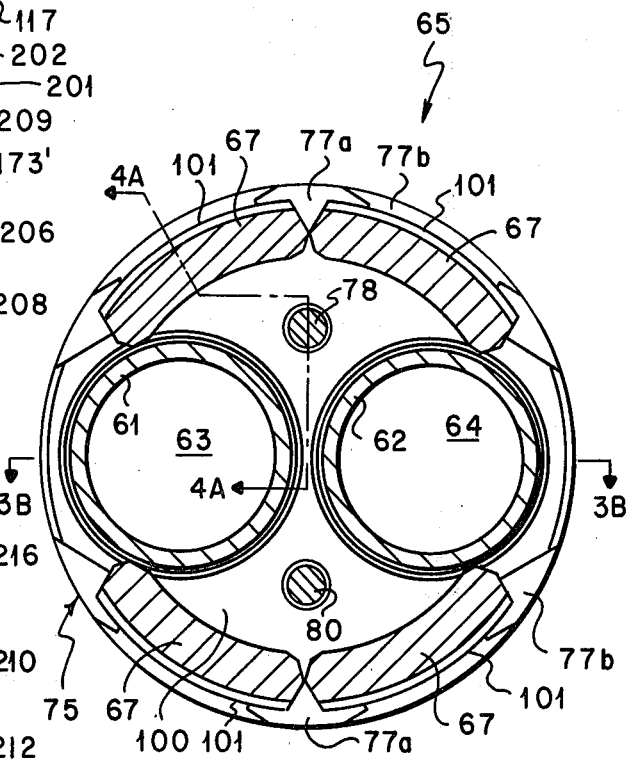
FIG. 25 demonstrates how the irregular section was taken at these three locations.

When sufficient force is applied to slip carrier 117, pins 122 will shear, allowing cylinders 119 and 120 to slide within their respective bores 113 and 114. Slip carrier 117 can then move longitudinally towards slip expander 111 to radially expand slip elements 67 as shown in FIGS. 22A and 23. Slip expander 111, slip elements 67, and slip carrier 117 cooperate to provide an anchoring means carried by lower body means 201 which is engageable with the interior of casing string 42 to prevent longitudinal movement of body means 201 relative thereto.

Figure 24:
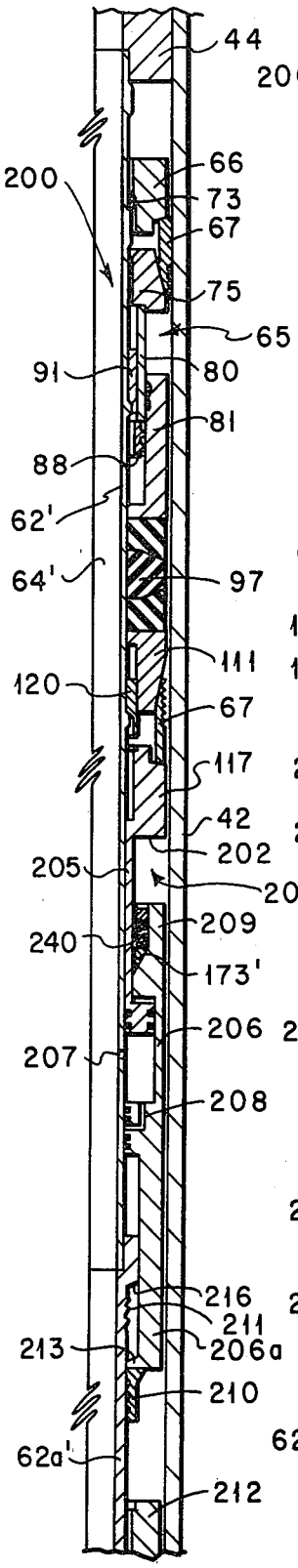
FIG. 24 is a schematic drawing partially in section with portions broken away showing the well packer of FIG. 23 being removed from the casing string.

Support plate 202 is positioned next to and abuts lower slip carrier 117. Support plate 202 has bores 203 and 204 with mandrel sections 61' and 62' slidably disposed therethrough. For ease of assembly, support plate 202 is a separate component. In FIGS. 23 and 24 slip carrier 117 and support plate 202 are shown as a single component. Piston 205 and piston housing 206 are carried on the exterior of mandrel means 61' and 62' adjacent to support plate 202. One end of piston 205 is slidably disposed within housing 206. The other end of piston 205 abuts support plate 202. Ports 207 as shown in FIGS. 23 and 24 extend radially through mandrel means 62' to communicate with passageway 208 through piston housing 206. Ports 207 and passageway 208 cooperate to communicate fluid pressure from passageway 64' to act upon piston 205. Piston 205 and piston housing 206 cooperate to provide a piston means for moving lower body means 201 longitudinally towards upper body means 65 in response to fluid pressure in passageway 64'. This longitudinal movement causes radial expansion of slips 67 and compression of packing means 97. Internal slips 173', springs 240, and slip housing 209 provide a portion of the means for locking lower body means 201 to mandrel means 61' and 62' after completion of the longitudinal movement of lower body means 201 towards upper body means 65.

Lower internal slip housing 209 surrounds piston 205 and is a continuation of piston housing 206. The cross section of packer 200 used in FIGS. 22A–C does not show internal slips 173'. A plurality of slip segments 173' is carried within housing 209 adjacent to piston 205 as shown in FIGS. 23 and 24. Beveled cam surfaces and springs 240 activate slips 173'. Teeth are formed on each slip 173' at an angle which allows longitudinal movement of piston 205 in only one direction relative to mandrel means 61' and 62'.

Figure 22B:
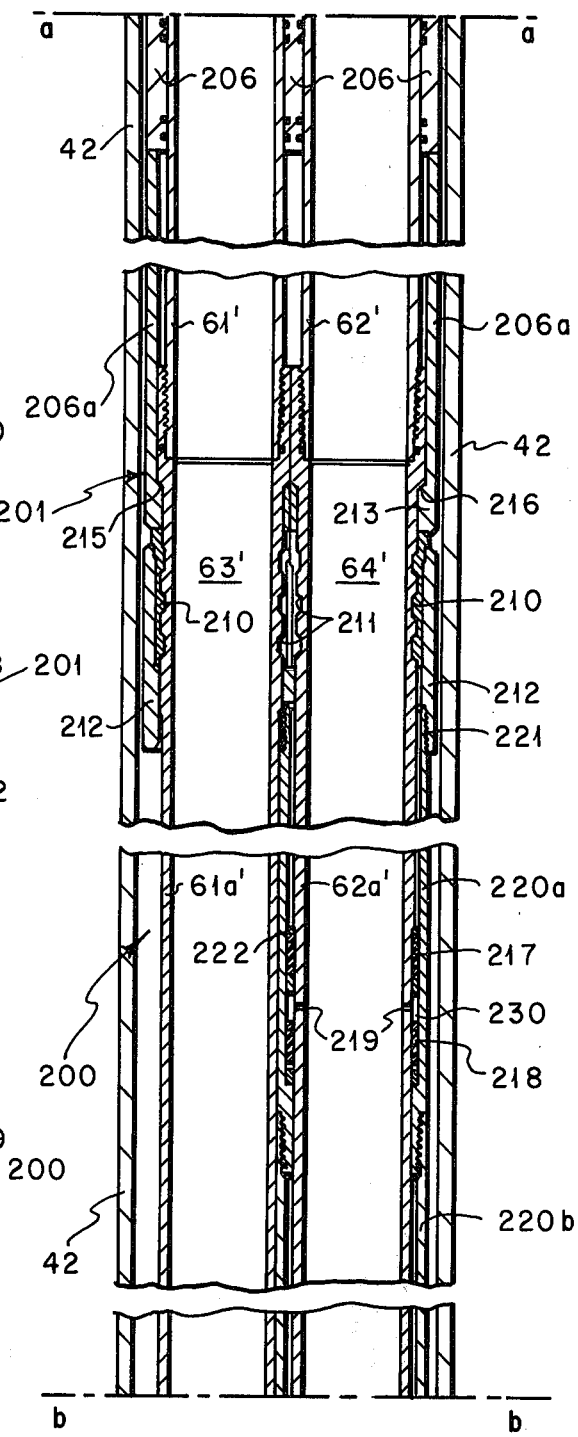
Figure 22C:
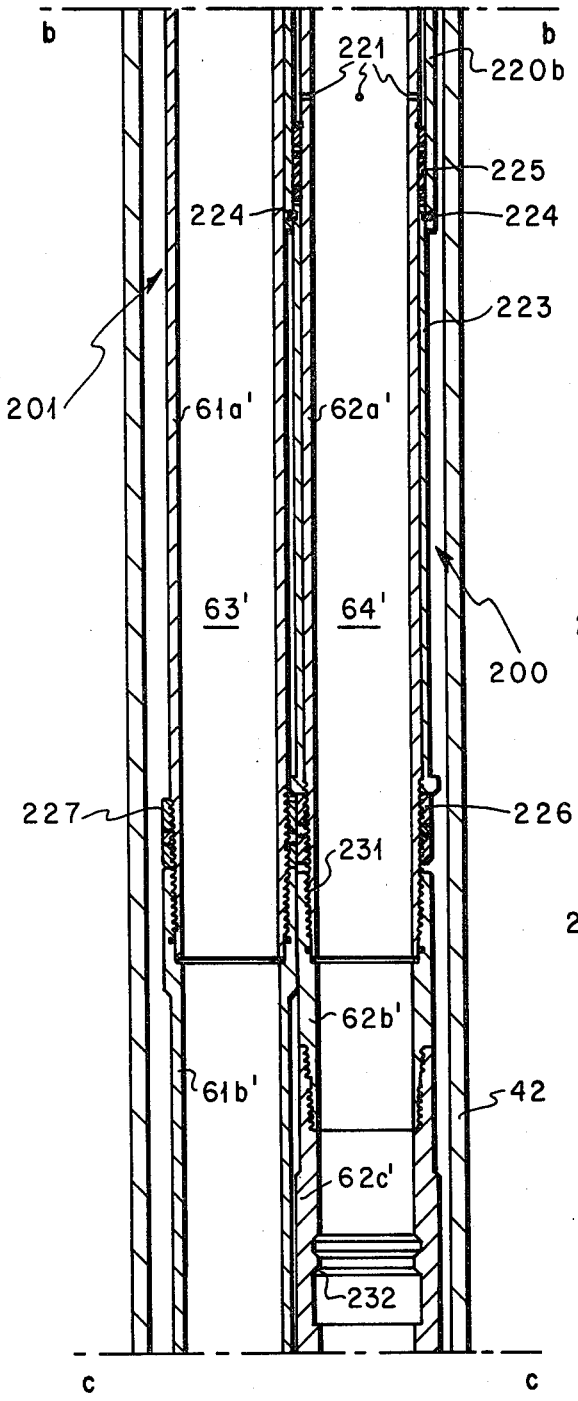
Figure 22D:
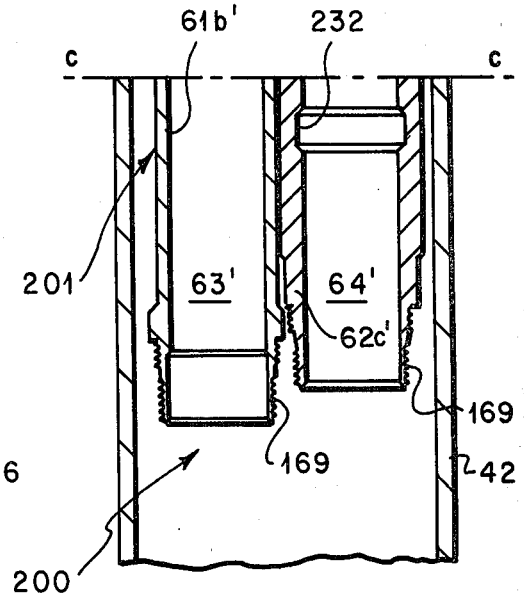

Piston housing 206 rests upon support cylinder **206*a*. In FIGS. 23 and 24, piston housing 206 and support cylinder 206*a* are shown as a single unit. For ease of manufacture and assembly, they are two separate components as shown in FIG. 22B. Support cylinder 206*a* is releasably secured to mandrel means 61' and 62' by snap ring 210. Mandrel means 61' and 62' include several sections of hollow tubing which are threadedly attached to each other. Sections 61*a'* and 62*a'* have exterior grooves 211 to receive snap ring 210. Backup ring 212 surrounds snap ring 210 and holds it engaged with grooves 211. Snap ring 210 traps flange 213 of support cylinder 206*a* against shoulders 215 and 216 on the exterior of mandrel sections 61*a'* and 62*a'* respectively. When flange 213 is so trapped, support cylinder 206*a* and thus piston housing 206 cannot move longitudinally relative to mandrel means 61' and 62'. Snap ring 210, grooves 211, shoulders 215 and 216 and backup ring 212 provide another portion of the means for releasably locking lower body means 201 to the exterior of mandrel means 61' and 62'**.

Sliding sleeve 220 is attached to backup ring 212 by threads 221 and surrounds the exterior of mandrel section **62*a'* below ring 212. Sleeve 220 consists of two sections designated 220*a* and 220*b*. Seal rings 217 and 218 are disposed between the exterior of mandrel sections 62*a'* and the interior of sliding sleeve section 220*a*. First ports 219 extend through the wall of mandrel section 62*a'* and communicate fluid pressure from passageway 64' to variable volume chamber 230 formed between seal rings 217 and 218. Second ports 221 extend through the wall of mandrel section 62*a'* and communicate fluid pressure from passageway 64' to the side of seal ring 218 opposite from first ports 219. When both first ports 219 and second ports 221 are open and passageway 64' is not blocked therebetween, fluid pressure on opposite sides of seal ring 218 is equalized. Shoulder 222 is provided on the exterior of mandrel section 61*a'* to provide a stop for seal ring 217. Therefore, when fluid pressure is increased within variable volume chamber 230, shoulder 222 limits the longitudinal movement of seal ring 217 away from first ports 219**.

Guide sleeve 223 is disposed around the exterior of mandrel section **62*a'* adjacent to sliding sleeve section 220*b*. The outside diameter of guide sleeve 223 is sized to telescope within the inside diameter of sliding sleeve section 220*b*. Shear screws 224 releasably attach sleeve section 220*b* and guide sleeve 223 to each other in their extended position. Seal ring 225 is provided on the exterior of mandrel section 62*a'* abutting the extreme end of guide sleeve 223 within sliding sleeve section 220*b*. Seal ring 225 prevents fluid communication between second ports 221 and the exterior of sliding sleeve 220. Guide sleeve 223 is supported by collar 226 on the exterior of mandrel section 62*a'*. Mandrel means 62' includes an adapter sub 62*b'* and a landing nipple 62*c'* attached by threads 231 to mandrel section 62*a'*. Landing nipple 62*c'* has internal locator recess or profile 232 for securing various well tools therein. Well tools (not shown) can be landed or locked into nipple 62*c'* for use in setting packer 200 at a desired downhole location and for use in releasing packer 200 from the downhole location. Landing nipple 62*c'* can be considered as either a part of mandrel means 62' or as part of the lower tubing string which would be attached to mandrel means 62' below packer 200**.

Operation Sequence

FIGS. 23 and 24 show the operating sequence of the various components within packer 200 as it is set or anchored at a downhole location within casing 42, and then released from casing 42. The components shown in FIGS. 23 and 24 are in schematic form only. The same numerical designations are used to allow correlation between the schematic representation of a component and its more detailed construction shown in the other figures. Only mandrel means 62' and its associated components will be discussed. FIGS. 23 and 24 demonstrate that the present invention could be used with a packer having a single mandrel means as well as a packer having dual mandrel means.

After packer 200 has been lowered to the desired downhole location, a suitable wireline tool can be locked into nipple **62*c'* to block passagewy 64'. An example of such a tool is shown in Otis Wireline Subsurface Flow Controls & Related Service Equipment Catalog (OEC 5121C) page 17. Fluid pressure within passageway 64' can then be increased via port 207 and passageway 208 to apply force to lower body means 201 by piston 205. During this time the same fluid pressure is present at both first ports 219 and second ports 221. Shear screws 124 are selected to release lower body means 201 from mandrel means 62' when fluid pressure acting upon piston 205 exceeds a first preselected value. After screws 124 are sheared, the force generated by piston 205 is transmitted to upper body means 201. Shear screws 76 are selected to have a shear value less than the shear value of shear screws 92 or 122. Thus, force generated by piston 205 will shear screws 76 to release upper slip expander 75 from mandrel means 62' after screws 124 have been sheared. This same force causes slip expander 75 to move longitudinally towards slip carrier 66 and radially expand slip elements 67 until they engage casing string 42. During this radial expansion of slip elements 67, slip carrier 66 is firmly abutted against orienting body 44 which is threadedly engaged with mandrel means 62'**.

After slip elements 67 on upper body means 65 have engaged the interior of casing string 42, fluid pressure action on piston 205 can be increased further to compress and radially expand packing means 97 between upper body means 65 and lower body means 201. The shear value of shear screws 122 is selected to allow the fluid acting on piston 205 to exceed a second preselected value prior to shearing screws 122. This second preselected fluid pressure corresponds to the force required to compress packing means 97 to form a fluid tight barrier between the exterior of mandrel means 62' and the interior of casing string 42. After screws 122 have been sheared, lower slip carrier 117 can slide longitudinally towards lower slip expander 111 to radially expand slip elements 67 and engage them with the interior of casing string 42 as shown in FIG. 23. Thus, lower body means 201 is anchored to casing string 42 to hold packing means 97 compressed and radially expanded. Internal slips 173' engage the exterior of piston 205 to hold piston 205 extended from piston housing 206. When fluid pressure within passageway 64' decreases, slips 173' prevent piston 205 from returning to its initial position. As long as piston housing 206 is anchored to the exterior of mandrel means 62' via snap ring 210, internal slips 173' and snap ring 210 can lock lower body means 201 to the exterior of mandrel means 62'. When packer 200 is anchored to the interior of casing string 42 as shown in FIG 23, packer 200 will resist both tension and compression forces from tubing strings 40 and 41. Packing means 97 will also seal against differences in fluid pressure in either direction within casing 42. Packer 200 can remain in this position indefinitely.

As the well conditions change, it may be necessary to remove packer 200 from its downhole location. A standard wireline locking mandrel or well tool with a tubing packoff tool attached (not shown) can be lowered through tubing string 40 and secured within locator recess or profiles 232 of nipple 62c'. The length of the locking mandrel and tubing packoff tool extending thereabove is selected such that the packoff tool will be disposed within mandrel section 62a' between ports 219 and 221 when the locking mandrel is positioned within profiles 232. Various packoff tools are commercially available for use with the present invention. Examples of such tools are shown in Otis Wireline Subsurface Flow Controls & Related Service Equipment Catalog (OEC 5121C) pages 14, 25 and 119. Profiles 232 and mandrel section 62a' cooperate to provide means for releasing the locking means for lower body means 201 from mandrel means 61' and 62'.

With the packoff positioned between first ports 219 and second ports 221, fluid pressure can be increased within variable volume chamber 230 creating a difference in pressure across seal ring 218. When this pressure difference reaches a preselected value, screws 224 will shear, allowing sliding sleeve 220 to telescope downwardly over the exterior of guide tube 223. This movement removes backup ring 212 from holding snap ring 210 engaged with grooves 211 as shown in FIG. 23. Dotted lines show the locked position for backup ring 212 in FIG. 23.

After backup ring 212 has been removed from supporting snap ring 210, mandrel means 62' can slide longitudinally relative to upper housing means 65 and lower housing means 201. Prior to this, slips 173' retained piston 205 locked relative to piston housing 206 which was in turn locked to mandrel means 62' by engagement of snap ring 210 with grooves 211. Upward tension can now be applied to lift orienting body 44 and mandrel means 62' attached thereto. This upward tension will shear screws 71 and 92 allowing mandrel means 62' to move longitudinally upward with respect to packing means 97. Mandrel means 62' is manipulated in the same manner as previously described for packer 60 to release upper body means 65 from casing 42.

Following release of upper body means 65, upward tension is next applied to mandrel means 62' via orienting body 44. Mandrel means 62 is now free to move upward. This upward movement causes internal slip elements 73 to re-engage slip carrier 66 lifting it upwards. Snap ring 126 on mandrel means 62' will contact separation cylinder 120 which in turn contacts lower slip expander 111. Thus, lifting mandrel means 62' will result in removing lower slip expander 111 from behind slip elements 67. Channels 98 cause slip elements 67 to retract which disengages lower body means 201 from its anchored position with the interior of casing string 42. Packer 200 can now be withdrawn from casing string 42. The configuration of the various components of packer 200 as it is withdrawn from a casing string 42 is shown in FIG. 24.

In summary, packer 200 is hydraulically set at a downhole location by applying fluid pressure to piston 205. Packer 200 is released from its set position by pressurizing variable volume chamber 230 and releasing snap ring 210. Mandrel means 62' is first lifted to free cylinder 88 from locking sleeve 91. Mandrel means 62 is next lowered to telescope first cylinder 80 into second cylinder 81 and to disengage upper body means 65 from the interior of casing string 42. Finally, mandrel means 62' is raised to move slip expander 111 upward and to release lower slips 67 from casing 42.

The previous descriptions of packers 60 and 200 are representative of only two embodiments of the present invention. Those skilled in the art will readily see other alternative changes and modifications without departing from the scope of the invention which is defined in the claims.

What is claimed is:

1. A well packer comprising:

a. a pair of parallel mandrel means, each having a passageway extending therethrough;

b. upper and lower body means carried on the exterior of the mandrel means and slidable longitudinally with respect to each other over the mandrel means;

c. anchoring means carried by each body means and radially expandable relative to each body means between a retracted position and an expanded position whereby each anchoring means is engageable with the interior of a casing string to prevent longitudinal movement of its associated body means relative to the casing string;

d. packing means carried on the exterior of the mandrel means between the upper and lower body means;

e. piston means, carried by said mandrel means, for moving the body means longitudinally toward each other in response to fluid pressure in one of the passageways;

f. the longitudinal movement of the body means causing compression of the packing means and radial expansion thereof to form a fluid barrier between the exterior of the mandrel means and the interior of the casing string;

g. the same longitudinal movement causing radial expansion of the anchoring means;

h. means for locking the lower body means to the mandrel means after completion of the longitudinal movement whereby the packing means are maintained compressed and the anchoring means are maintained radially expanded;

i. each anchoring means comprising a plurality of slip elements;

j. each body means further comprising a slip carrier and a slip expander which are movable longitudinally towards each other to radially expand the associated slip elements;

k. means for releasing the mandrel means from the locking means of the lower body means; and l. means for moving the slip expander of the upper body means longitudinally away from its associated slip carrier to allow retraction of the slip elements carried by the upper body means after the locking means for the lower body means has been released.

2. A well packer as defined in claim 1, wherein the locking means further comprises:

a. slip segments disposed between the exterior of the mandrel means and the interior of the lower body means;

b. teeth projecting from each slip segment at an angle relative to the mandrel means whereby the slip segments allow longitudinal movement of the lower body means towards the upper body means and prevent longitudinal movement of the body means away from each other; and c. a camming surface formed on the interior of the lower body means to project the slip segments adjacent thereto into contact with the mandrel means.

3. A well packer as defined in claim 1, wherein the upper body means further comprises:

a. first and second concentric cylinders surrounding the mandrel means between the slip expander for the upper body means and the packing means;

b. the outside diameter of the first cylinder selected to telescope within the inside diameter of the second cylinder;

c. a retaining cylinder releasably disposed between the exterior of the mandrel means and the inside diameter of the second cylinder;

d. the retaining cylinder abutting the first cylinder and thereby blocking the first and second cylinders from telescoping relative to each other;

e. a locking sleeve disposed between the mandrel means and the retaining cylinder; and f. a shoulder carried on the exterior of the mandrel means within the second cylinder adjacent to the locking sleeve whereby longitudinal movement of the mandrel means in one direction relative to the second cylinder will cause the shoulder to contact the locking sleeve and release the engagement between the mandrel means, locking sleeve, retaining cylinder and second cylinder allowing the first and second cylinders to telescope relative to each other.

4. A well packer as defined in claim 3, wherein the first and second cylinders prevent the slip expander of the upper body means from moving longitudinally away from its associated slip carrier until after the retaining cylinder has been released.

5. A well packer as defined in claim 1, wherein the releasing means for the locking means of the lower body means further comprises:

a. a locator recess in either the passageway of one of the mandrel means or the tubing string attached to the mandrel means;

b. a well tool releasably engageable with the locator recess;

c. a tubing cutting tool attached to the well tool and extending longitudinally therefrom; and d. the distance between the cutting tool and the well tool selected to equal the distance from the locator recess to a preselected location within the mandrel means.

6. A well packer as defined in claim 1, further comprising:

a. a port extending radially through one of the mandrel means;

b. a conduit for communicating fluid from the port to the piston means; and c. the piston means secured to the exterior of the mandrel means adjacent to and abutting the lower body means.

7. A well packer as defined in claim 1, further comprising:

a. the piston means including a piston slidably disposed within a piston housing;

b. slip segments disposed between the piston and the piston housing;

c. teeth projecting from each slip segment at an angle relative to the piston whereby the slip segments allow fluid pressure to extend the piston from the piston housing and prevent the piston from returning to its initial position; and d. a snap ring which releasably secures the piston housing to the mandrel means.

8. A well packer as defined in claim 1, further comprising an orienting body disposed above the upper body means and each mandrel means securely engaged with the orienting body preventing relative movement between the mandrel means.

9. A well packer as defined in claim 1, further comprising:

a. releasable means for securing the lower body means to the mandrel means until fluid pressure within the piston means exceeds a first preselected value;

b. releasable means for preventing longitudinal movement of the slip expander of the upper body means relative to its associated slip carrier until fluid pressure within the piston means exceeds the first preselected value; and c. releasable means for preventing longitudinal movement of the slip expander of the lower body means relative to its associated slip carrier until fluid pressure within the piston means exceeds a second, higher preselected value.

10. A well packer which can be attached to a tubing string for the purpose of forming a fluid barrier within a casing string, comprising:

a. mandrel means having a passageway extending therethrough;
b. upper and lower body means carried on the exterior of the mandrel means and slidable longitudinally with respect to each other over the mandrel means;
c. anchoring means carried by each body means and movable relative to each body means between a retracted position and an expanded position whereby each anchoring means is engageable with the interior of the casing string to prevent longitudinal movement of its associated body means relative to the casing string;
d. packing means carried on the exterior of the mandrel means between the upper and lower body means;
e. piston means, carried by the mandrel means, for moving the body means longitudinally toward each other in response to fluid pressure in the passageway;
f. longitudinal movement of the lower body means towards the upper body means causing compression of the packing means and radial expansion thereof to form the fluid barrier;
g. the same longitudinal movement causing expansion of the anchoring means;
h. means for locking the lower body means to the mandrel means;
i. means for releasing the mandrel means from the locking means of the lower body means;
j. means for moving the slip expander of the upper body means longitudinally away from its associated slip carrier to retract the slip elements carried by the upper body means after the locking means for the lower body means has been released;
k. releasable means securing the lower body means to the mandrel means until fluid pressure within the piston means exceeds a first preselected value;
l. releasable means preventing longitudinal movement of the slip expander of the upper body means relative to its associated slip carrier until fluid pressure within the piston means exceeds the first preselected value; and
m. releasable means preventing longitudinal movement of the slip expander of the lower body means relative to its associated slip carrier until fluid pressure within the piston means exceeds a second preselected value.

11. A well packer as defined in claim 2 or 10, further comprising:
a. the change in fluid pressure within the piston means between the first and second preselected value compressing the packing means; and
b. the locking means for the lower body means maintaining the packing means compressed without regard to fluid pressure in the piston means.

12. A well packer as defined in claim 1 or 10, wherein the means for releasing the lower body means comprises:
a. a first and a second shoulder formed on the exterior of the mandrel means between the slip carrier of the lower body means and its associated locking means;
b. the shoulders spaced longitudinally from each other;
c. first and second shoulders carried by the lower body means;
d. the first and second shoulders of the lower body means spaced longitudinally from each other;
e. the shoulders of the mandrel means positioned between the shoulders of the lower body means; and
f. the shoulders of the mandrel means sized to engage the shoulders of the lower body means.

13. A well packer as defined in claim 1 or 10, wherein the means for releasing the locking means of the lower body means further comprises:
a. a snap ring releasably secured to the exterior of the mandrel means below the piston means;
b. a backup ring which normally maintains the snap ring secured to the mandrel means;
c. the snap ring and a shoulder on the exterior of the mandrel means cooperating to lock the lower body means to the mandrel means;
d. a hydraulically actuated sliding sleeve surrounding the mandrel means and attached to the backup ring; and
e. means for communicating fluid pressure from the passageway to the sliding sleeve whereby fluid pressure above a preselected value will move the sliding sleeve longitudinally to release the snap ring from the mandrel means.

14. A well packer, carried by a tubing string, for forming a fluid barrier within a casing string, comprising:
a. a mandrel means having a passageway extending longitudinally therethrough and each end of the mandrel means engageable with the tubing string;
b. upper and lower body means carried on the exterior of the mandrel means and slidable longitudinally over the exterior of the mandrel means;
c. anchoring means carried by each body means and movable relative to the respective body means between a retracted position and an expanded position whereby each anchoring means is engageable with the interior of the casing string to prevent longitudinal movement of its associated body means relative thereto;
d. packing means carried on the exterior of the mandrel means between the upper and lower body means;
e. piston means, carried by the mandrel means, for moving the body means longitudinally toward each other in response to fluid pressure in the passageway;
f. longitudinal movement of the body means toward each other causing compression of the packing means and radial expansion thereof to form a fluid barrier between the exterior of the mandrel means and the interior of the casing string;
g. the same longitudinal movement causing radial expansion of the anchoring means;
h. means for locking the lower body means to the exterior of the mandrel means after completion of the longitudinal movement whereby the packing means are maintained compressed and the anchoring means are maintained radially expanded;
i. each anchoring means comprising a plurality of slip elements;
j. each body means further comprising a slip carrier and a slip expander which are movable longitudinally towards each other to radially expand the slip elements;
k. a first and a second shoulder formed on the exterior of the mandrel means between the slip carrier of the lower body means and its associated locking means;

l. the shoulders spaced longitudinally from each other;

m. first and second shoulders carried by the lower body means projecting radially inward toward the mandrel means;

n. the first and second shoulders of the lower body means spaced longitudinally from each other;

o. the shoulders of the mandrel means positioned between the shoulders of the lower body means; and p. the shoulders of the mandrel means sized to engage the shoulders of the lower body means.

15. A well packer as defined in claim 14, wherein means for releasing the locking means of the lower body means comprises:

a. a profile in either the passageway of the mandrel means or the tubing string attached to the mandrel means;

b. a well tool releasably engageable with the profile;

c. a tubing cutting tool attached to the well tool and extending longitudinally therefrom; and d. the distance between the cutting tool and the well tool selected to equal the distance from the profile to a preselected location intermediate the first and second shoulders of the mandrel means.

16. A well packer as defined in claim 14, wherein the mandrel means comprises:

a. a pair of parallel mandrels, each having a passageway extending longitudinally therethrough;

b. a port extending radially through one of the mandrel means;

c. a conduit for communicating fluid from the port to the piston means; and d. the piston means secured to the exterior of the mandrel means adjacent to and abutting the lower body means.

* * * * *